US009030122B2

(12) United States Patent
Yan et al.

(10) Patent No.: US 9,030,122 B2
(45) Date of Patent: May 12, 2015

(54) CIRCUITS AND METHODS FOR DRIVING LED LIGHT SOURCES

(75) Inventors: Tiesheng Yan, Chengdu (CN); Feng Lin, Chengdu (CN); Youling Li, Shenzen (CN); Ching-Chuan Kuo, Taipei (TW)

(73) Assignee: O2Micro, Inc., Santa Clara, CA (US)

( * ) Notice: Subject to any disclaimer, the term of this patent is extended or adjusted under 35 U.S.C. 154(b) by 722 days.

(21) Appl. No.: 13/369,620

(22) Filed: Feb. 9, 2012

(65) Prior Publication Data

US 2013/0038227 A1 Feb. 14, 2013

Related U.S. Application Data

(63) Continuation-in-part of application No. 12/783,260, filed on May 19, 2010, now Pat. No. 8,330,388, and a continuation-in-part of application No. 12/316,480, filed on Dec. 12, 2008, now Pat. No. 8,044,608.

(30) Foreign Application Priority Data

Dec. 28, 2011 (CN) ..... 2011 1 0447599

(51) Int. Cl.
*H05B 37/02* (2006.01)
*H05B 33/08* (2006.01)

(52) U.S. Cl.
CPC ..... *H05B 33/0851* (2013.01); *H05B 33/0818* (2013.01); *H05B 33/0848* (2013.01)

(58) Field of Classification Search
USPC ..... 315/185 R, 186, 193, 209 R, 210, 211, 315/219, 224, 225, 244, 245, 246, 283, 287, 315/291, 307, 312–314, 362
See application file for complete search history.

(56) References Cited

U.S. PATENT DOCUMENTS 5,691,605 A 11/1997 Xia et al.
5,959,443 A 9/1999 Littlefield
(Continued)

FOREIGN PATENT DOCUMENTS

CN 1498055 A 5/2004
CN 1694597 A 11/2005
(Continued)

OTHER PUBLICATIONS

The datasheet describes an universal high brightness LED driver HV9910B from Supertex Inc.
(Continued)

*Primary Examiner* — Jimmy Vu

(57) ABSTRACT

A driving circuit for controlling power of a light-emitting diode (LED) light source includes a transformer, a switch controller, and a dimming controller. The transformer has a primary winding that receives input power from an AC/DC converter and a secondary winding that provides output power to the LED light source. The switch controller coupled between an optical coupler and the primary winding receives a feedback signal indicative of a target level of a current flowing through the LED light source from the optical coupler, and controls input power to the primary winding according to the feedback signal. The dimming controller coupled to the secondary winding receives a switch monitoring signal indicative of an operation of a power switch coupled between an AC power source and the AC/DC converter, and regulates the output power by adjusting the feedback signal according to the switch monitoring signal.

20 Claims, 26 Drawing Sheets

(56) References Cited

U.S. PATENT DOCUMENTS

| | | | |
|---|---|---|---|
| 6,304,464 | B1 | 10/2001 | Jacobs et al. |
| 6,320,330 | B1 | 11/2001 | Haavisto et al. |
| 6,727,662 | B2 | 4/2004 | Konopka et al. |
| 6,839,247 | B1 | 1/2005 | Yang et al. |
| 6,946,819 | B2 | 9/2005 | Fagnani et al. |
| 6,975,078 | B2 | 12/2005 | Yanai et al. |
| 6,984,963 | B2 | 1/2006 | Pidutti et al. |
| 7,084,582 | B2 | 8/2006 | Buonocunto |
| 7,141,940 | B2 | 11/2006 | Ortiz |
| 7,148,664 | B2 | 12/2006 | Takahashi et al. |
| 7,180,274 | B2 | 2/2007 | Chen et al. |
| 7,190,124 | B2 | 3/2007 | Kumar et al. |
| 7,259,527 | B2 | 8/2007 | Foo |
| 7,288,902 | B1 | 10/2007 | Melanson |
| 7,304,464 | B2 | 12/2007 | Weng et al. |
| 7,312,783 | B2 | 12/2007 | Oyama |
| 7,323,828 | B2 | 1/2008 | Russell et al. |
| 7,466,082 | B1 | 12/2008 | Snyder et al. |
| 7,639,517 | B2 | 12/2009 | Zhou et al. |
| 7,649,325 | B2 | 1/2010 | McIntosh et al. |
| 7,710,084 | B1 | 5/2010 | Guo |
| 7,714,464 | B2 | 5/2010 | Tsai et al. |
| 7,759,881 | B1 | 7/2010 | Melanson |
| 7,800,315 | B2 | 9/2010 | Shteynberg |
| 7,804,256 | B2 | 9/2010 | Melanson |
| 7,852,017 | B1 | 12/2010 | Melanson |
| 7,863,828 | B2 | 1/2011 | Melanson |
| 7,888,922 | B2 | 2/2011 | Melanson |
| 7,944,153 | B2 | 5/2011 | Greenfeld |
| 8,076,867 | B2 | 12/2011 | Kuo et al. |
| 8,085,005 | B2 | 12/2011 | Dearn |
| 8,232,780 | B2 | 7/2012 | Uno |
| 8,237,371 | B2 | 8/2012 | Lin et al. |
| 8,274,800 | B2 | 9/2012 | Uno et al. |
| 8,339,063 | B2 | 12/2012 | Yan et al. |
| 8,344,657 | B2 | 1/2013 | Zhan et al. |
| 8,378,588 | B2 | 2/2013 | Kuo et al. |
| 8,379,413 | B2 | 2/2013 | Ren et al. |
| 2001/0005319 | A1 | 6/2001 | Ohishi et al. |
| 2003/0048632 | A1 | 3/2003 | Archer |
| 2003/0107332 | A1 | 6/2003 | Newman et al. |
| 2004/0085030 | A1 | 5/2004 | Laflamme et al. |
| 2004/0130271 | A1 | 7/2004 | Sekoguchi et al. |
| 2004/0218410 | A1 | 11/2004 | Yamada et al. |
| 2005/0017691 | A1 | 1/2005 | Aradachi et al. |
| 2006/0012997 | A1 | 1/2006 | Catalano et al. |
| 2006/0072324 | A1 | 4/2006 | Hachiya et al. |
| 2006/0139907 | A1 | 6/2006 | Yen |
| 2007/0047276 | A1 | 3/2007 | Lin et al. |
| 2007/0182347 | A1 | 8/2007 | Shteynberg et al. |
| 2007/0210725 | A1 | 9/2007 | Marosek |
| 2007/0262724 | A1 | 11/2007 | Mednik et al. |
| 2008/0018261 | A1* | 1/2008 | Kastner ..... 315/192 |
| 2008/0030153 | A1 | 2/2008 | Mizuno |
| 2008/0180075 | A1 | 7/2008 | Xie et al. |
| 2008/0203946 | A1 | 8/2008 | Ito et al. |
| 2008/0224631 | A1 | 9/2008 | Melanson |
| 2008/0258641 | A1 | 10/2008 | Nakagawa et al. |
| 2008/0258647 | A1 | 10/2008 | Scianna |
| 2008/0259655 | A1 | 10/2008 | Wei et al. |
| 2008/0278092 | A1 | 11/2008 | Lys et al. |
| 2008/0297068 | A1 | 12/2008 | Koren et al. |
| 2009/0167187 | A1 | 7/2009 | Kitagawa et al. |
| 2009/0184662 | A1 | 7/2009 | Given et al. |
| 2009/0189548 | A1 | 7/2009 | Hoffman et al. |
| 2009/0195180 | A1 | 8/2009 | Chenetz |
| 2009/0224686 | A1 | 9/2009 | Kunimatsu |
| 2009/0251059 | A1 | 10/2009 | Veltman |
| 2009/0251071 | A1 | 10/2009 | Gater et al. |
| 2009/0295303 | A1 | 12/2009 | Pucko et al. |
| 2009/0322254 | A1 | 12/2009 | Lin |
| 2009/0322255 | A1 | 12/2009 | Lin |
| 2010/0007292 | A1 | 1/2010 | Horino |
| 2010/0013409 | A1 | 1/2010 | Quek et al. |
| 2010/0026191 | A1 | 2/2010 | Radermacher et al. |
| 2010/0141177 | A1 | 6/2010 | Negrete et al. |
| 2010/0148681 | A1 | 6/2010 | Kuo et al. |
| 2010/0265745 | A1 | 10/2010 | Xu et al. |
| 2010/0308733 | A1 | 12/2010 | Shao |
| 2011/0001766 | A1 | 1/2011 | Hua et al. |
| 2011/0013437 | A1 | 1/2011 | Uruno et al. |
| 2011/0037399 | A1 | 2/2011 | Hung et al. |
| 2011/0050185 | A1 | 3/2011 | Notman et al. |
| 2011/0109228 | A1 | 5/2011 | Shimomura et al. |
| 2011/0115407 | A1 | 5/2011 | Wibben et al. |
| 2011/0128303 | A1 | 6/2011 | Yonemaru et al. |
| 2011/0133665 | A1 | 6/2011 | Huang |
| 2011/0140620 | A1 | 6/2011 | Lin et al. |
| 2011/0140630 | A1 | 6/2011 | Doudousakis et al. |
| 2011/0227506 | A1 | 9/2011 | Ren et al. |
| 2011/0285307 | A1 | 11/2011 | Kimura et al. |
| 2011/0298374 | A1 | 12/2011 | Lenk et al. |
| 2012/0069606 | A1 | 3/2012 | Sagneri et al. |
| 2012/0081018 | A1 | 4/2012 | Shteynberg et al. |
| 2012/0081029 | A1 | 4/2012 | Choi et al. |
| 2012/0139433 | A1 | 6/2012 | Yan et al. |
| 2012/0146532 | A1 | 6/2012 | Ivey et al. |
| 2012/0217894 | A1 | 8/2012 | Chang et al. |
| 2012/0242247 | A1 | 9/2012 | Hartmann et al. |
| 2012/0293087 | A1 | 11/2012 | Matsuda et al. |
| 2013/0033197 | A1 | 2/2013 | Hwang et al. |
| 2013/0043801 | A1 | 2/2013 | Kuwu |
| 2013/0049621 | A1 | 2/2013 | Yan et al. |
| 2013/0147379 | A1 | 6/2013 | Zhou et al. |

FOREIGN PATENT DOCUMENTS

| | | | |
|---|---|---|---|
| CN | 1760721 | A | 4/2006 |
| CN | 101176386 | A | 5/2008 |
| CN | 101179879 | A | 5/2008 |
| CN | 101193486 | A | 6/2008 |
| CN | 101222800 | A | 7/2008 |
| CN | 101242143 | A | 8/2008 |
| CN | 101370335 | A | 2/2009 |
| CN | 101378207 | A | 3/2009 |
| CN | 101466186 | A | 6/2009 |
| CN | 101472368 | A | 7/2009 |
| CN | 101489335 | A | 7/2009 |
| CN | 101500354 | A | 8/2009 |
| CN | 101511136 | A | 8/2009 |
| CN | 101572974 | A | 11/2009 |
| CN | 101605413 | A | 12/2009 |
| CN | 101605416 | A | 12/2009 |
| CN | 201491339 | U | 5/2010 |
| CN | 101742771 | A | 6/2010 |
| CN | 101801129 | A | 8/2010 |
| CN | 101815383 | A | 8/2010 |
| CN | 101815391 | A | 8/2010 |
| CN | 101854759 | A | 10/2010 |
| CN | 201611973 | U | 10/2010 |
| CN | 201682668 | U | 12/2010 |
| CN | 101998726 | A | 3/2011 |
| CN | 102014540 | A | 4/2011 |
| CN | 102056378 | A | 5/2011 |
| CN | 102118906 | A | 7/2011 |
| CN | 202050564 | U | 11/2011 |
| CN | 102332814 | A | 1/2012 |
| CN | 102387639 | A | 3/2012 |
| CN | 102522066 | A | 6/2012 |
| CN | 102696282 | A | 9/2012 |
| DE | 29904988 | U1 | 6/1999 |
| EP | 1565042 | A2 | 8/2005 |
| EP | 2026634 | A1 | 2/2009 |
| EP | 2031942 | A2 | 3/2009 |
| EP | 2214457 | A1 | 8/2010 |
| EP | 2273851 | A2 | 1/2011 |
| EP | 2320710 | A1 | 5/2011 |
| EP | 2533606 | A1 | 12/2012 |
| GB | 2482371 | A | 2/2012 |
| JP | 10070846 | A | 3/1998 |
| JP | 2001185371 | A | 7/2001 |
| JP | 2001245436 | A | 9/2001 |
| JP | 2008210536 | A | 9/2008 |
| JP | 2010140823 | A | 6/2010 |

(56) References Cited

FOREIGN PATENT DOCUMENTS

| | | | |
|---|---|---|---|
| JP | 2010140824 | A | 6/2010 |
| JP | 2010282757 | A | 12/2010 |
| JP | 2011009701 | A | 1/2011 |
| TW | M390631 | U | 10/2010 |
| TW | M399572 | U | 3/2011 |
| WO | 2006006085 | A1 | 1/2006 |
| WO | 2008001246 | A1 | 1/2008 |
| WO | 2010148329 | A1 | 12/2010 |
| WO | 2011048214 | A1 | 4/2011 |

OTHER PUBLICATIONS

The datasheet describes a PWM high efficiency LED driver controller A704 from ADDtek Corp., Aug. 2008.

European search report dated Oct. 4, 2013 issued in European Patent Application No. 12161538.9 (9 pages).

Japanese Office Action dated Oct. 15, 2013 issued in Japanese Patent Application 2010-258837 (3 pages).

Datasheet of "Close Loop LED Driver with Enhanced PWM Dimming" from Supertex Inc, Dec. 31, 2009, pp. 1-12, XP002714011, CA, 94089, US.

Application report of "Driving High-Current LEDs" from Texas Instrument, Jan. 31, 2007, pp. 1-8, XP002714012.

GB Office Action dated Jan. 14, 2013 issued in related GB patent Application No. 1313787.2 (5 pages).

European Search Report dated Dec. 11, 2013 issued in related patent Application No. 13150915.0 (5 pages).

Combined Search and Examination Report dated Jun. 26, 2014 issued for British Patent Application No. 1405042.1.

* cited by examiner

CIRCUITS AND METHODS FOR DRIVING LED LIGHT SOURCES

RELATED APPLICATIONS

The present application claims priority to Chinese Patent Application No. 201110447599.X, titled "Driving Circuit, Dimming Controller and Method for Power Control of LED Light Source," filed on Dec. 28, 2011 with the State Intellectual Property Office of the People's Republic of China, and the present application is also a continuation-in-part of the U.S. application Ser. No. 12/783,260, titled "Circuits and Methods for Driving Light Sources," filed on May 19, 2010, which itself is a continuation-in-part of U.S. application Ser. No. 12/316,480, titled "Driving Circuit with Dimming Controller for Driving Light Sources," filed on Dec. 12, 2008 (now U.S. Pat. No. 8,044,608, issued on Oct. 25, 2011), and all of which are fully incorporated herein by reference.

BACKGROUND

In recent years, light sources such as light emitting diodes (LEDs) have been improved through technological advances in material and manufacturing processes. LED possesses relatively high efficiency, long life, vivid colors and can be used in a variety of industries including the automotive, computer, telecom, military and consumer goods, etc. One example is an LED lamp which uses LEDs to replace traditional light sources such as electrical filament.

FIG. 1 shows a schematic diagram of a conventional LED driving circuit 100. The LED driving circuit 100 utilizes an LED string 106 as a light source. The LED string 106 includes a group of LEDs connected in series. A power converter 102 converts an input voltage Vin to a desired output DC voltage Vout for powering the LED string 106. A switch 104 coupled to the power converter 102 is used to turn the LED lamp on or off. The power converter 102 receives a feedback signal from a current sensing resistor Rsen and adjusts the output voltage Vout to make the LED string 106 generate a desired light output. One of the drawbacks of this solution is that during operation, the light output of the LED string 106 is set to a predetermined level and may not be adjusted by users.

FIG. 2 illustrates a schematic diagram of another conventional LED driving circuit 200. A power converter 102 converts an input voltage Vin to a desired output DC voltage Vout for powering the LED string 106. A switch 104 coupled to the power converter 102 is used to turn the LED lamp on or off. The LED string 106 is coupled to a linear LED current regulator 208. An operational amplifier 210 in the linear LED current regulator 208 compares a reference signal REF with a current monitoring signal from a current sensing resistor Rsen, and generates a control signal to adjust the resistance of transistor Q1 in a linear mode. Therefore, the LED current flowing through the LED string 106 can be adjusted accordingly. However, in order to allow the user to adjust the light output of the LED string 106, a special designed switch, e.g., a switch with adjusting buttons or a switch that can receive a remote control signal, is needed, and thus the cost is increased.

SUMMARY

In one embodiment, a driving circuit for controlling power of a light-emitting diode (LED) light source includes a transformer, a switch controller, and a dimming controller. The transformer has a primary winding operable for receiving input power from an AC/DC converter and a secondary winding operable for providing output power to the LED light source. The switch controller coupled between an optical coupler and the primary winding is operable for receiving a feedback signal indicative of a target level of a current flowing through the LED light source from the optical coupler, and for controlling input power to the primary winding according to the feedback signal. The dimming controller coupled to the secondary winding is operable for receiving a switch monitoring signal indicative of an operation of a power switch coupled between an AC power source and the AC/DC converter, and for regulating the output power of the transformer by adjusting the feedback signal according to the switch monitoring signal.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Figure 1:
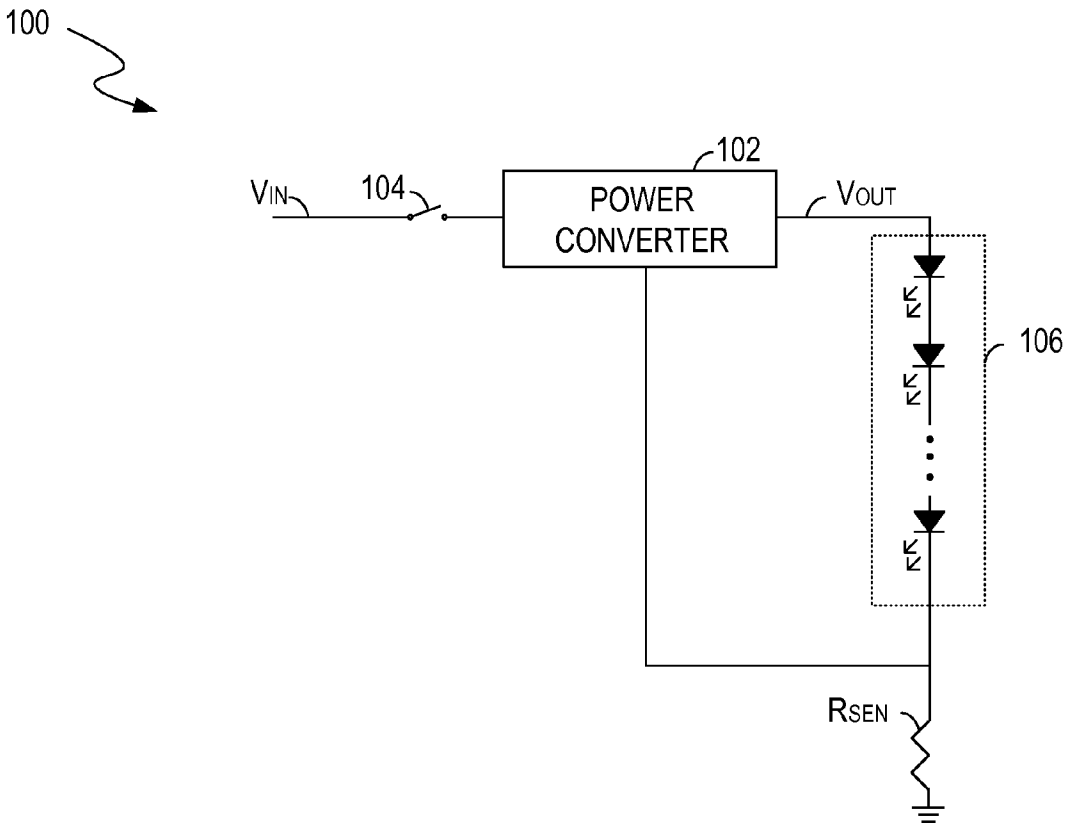
FIG. 1 PRIOR ART
FIG. 1 shows a schematic diagram of a conventional LED driving circuit.
Figure 2:
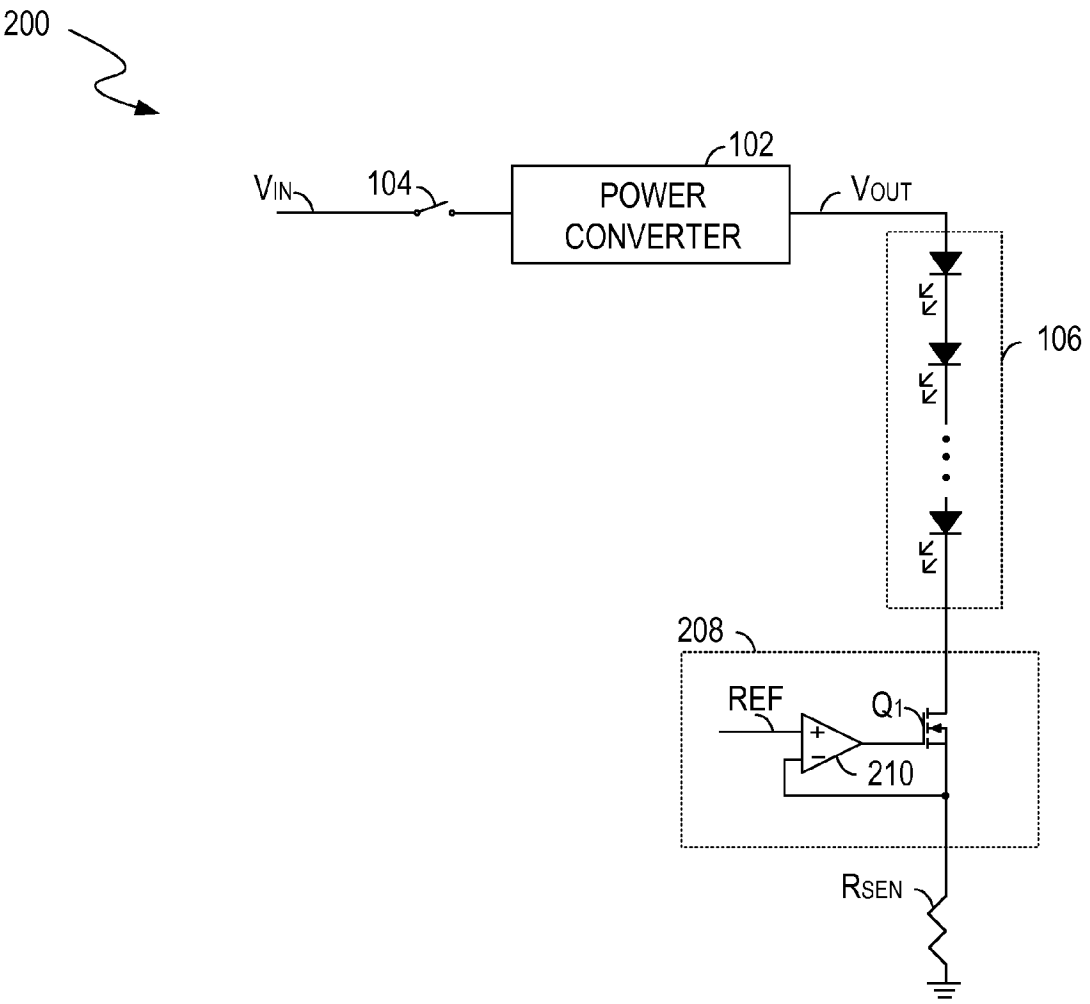
FIG. 2 PRIOR ART
FIG. 2 shows a schematic diagram of another conventional LED driving circuit.
Figure 3:
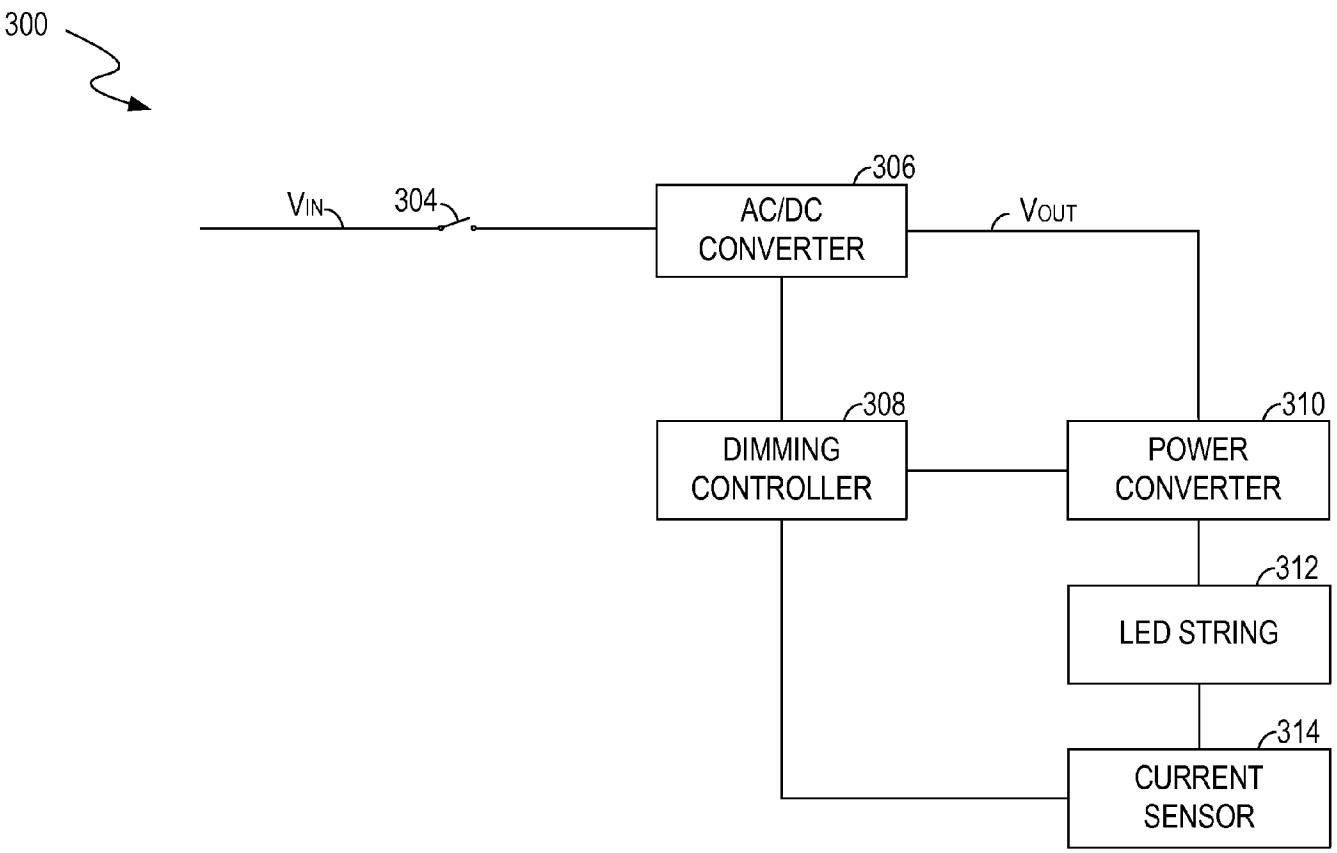
FIG. 3 shows a block diagram of a light source driving circuit, in accordance with one embodiment of the present invention.
Figure 19:
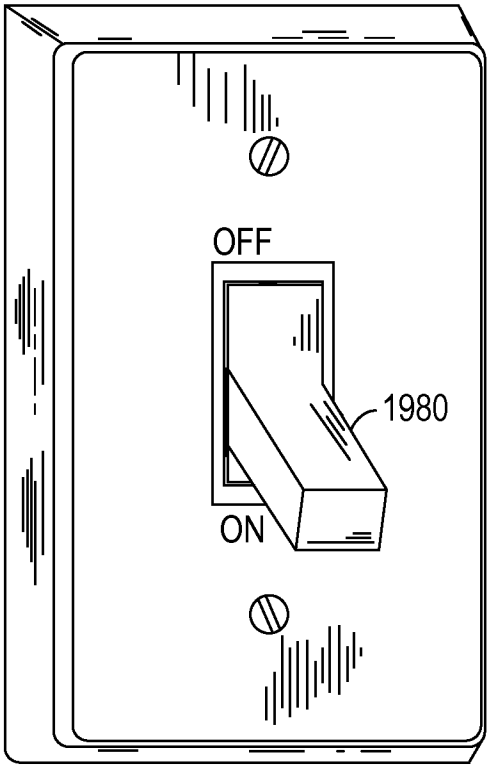
FIG. 19 shows an example of a power switch in FIG. 18, in accordance with one embodiment of the present invention.

FIG. 3 shows an example of a block diagram of a light source driving circuit 300, in accordance with one embodiment of the present invention. In one embodiment, the light source driving circuit 300 includes an AC/DC converter 306 for converting an AC input voltage Vin from a power source to a DC voltage Vout, a power switch 304 coupled between the power source and the AC/DC converter 306 for selectively coupling the power source to the light source driving circuit 300, a power converter 310 coupled to the AC/DC converter 306 for providing an LED string 312 with a regulated power, a dimming controller 308 coupled to the power converter 310 for receiving a switch monitoring signal indicative of an operation of the power switch 304 and for adjusting the regulated power from the power converter 310 according to the switch monitoring signal, and a current sensor 314 for sensing an LED current flowing through the LED string 312. In one embodiment, the power switch 304 can be an on/off switch mounted on the wall. By switching a handle, the conductance status of the power switch 304 is controlled on or off, e.g., by a user. An example of the power switch 304 is illustrated in FIG. 19 according to one embodiment of the present invention.

In operation, the AC/DC converter 306 converts the input AC voltage Vin to the output DC voltage Vout. The power converter 310 receives the DC voltage Vout and provides the LED string 312 with a regulated power. The current sensor 314 generates a current monitoring signal indicating a level of an LED current flowing through the LED string 312. The dimming controller 308 monitors the operation of the power switch 304, receives the current monitoring signal from the current sensor 314, and controls the power converter 310 to adjust the power of the LED string 312 in response to the operation of the power switch 304. In one embodiment, the dimming controller 308 operates in an analog dimming mode and adjusts the power of the LED string 312 by adjusting a reference signal indicating a peak value of the LED current. In another embodiment, the dimming controller 308 operates in a burst dimming mode and adjusts the power of the LED string 312 by adjusting a duty cycle of a pulse-width modulation (PWM) signal. By adjusting the power of the LED string 312, the light output of the LED string 312 is adjusted accordingly.

Figure 4:
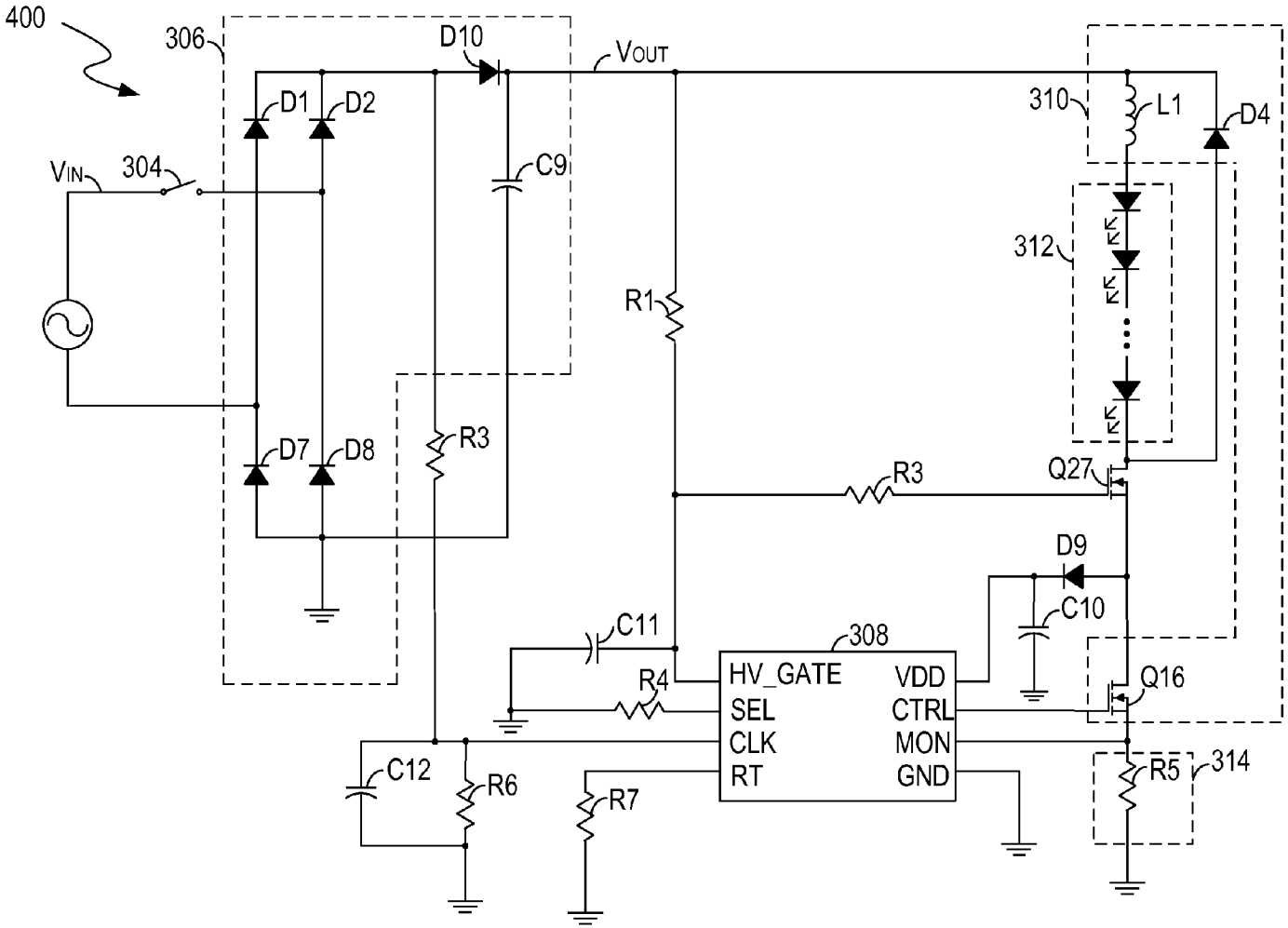
FIG. 4 shows a schematic diagram of a light source driving circuit, in accordance with one embodiment of the present invention.

FIG. 4 shows an example of a schematic diagram of a light source driving circuit 400, in accordance with one embodiment of the present invention. FIG. 4 is described in combination with FIG. 3. Elements labeled the same as in FIG. 3 have similar functions.

The light source driving circuit 400 includes a power converter 310 coupled to a power source and coupled to an LED string 312 for receiving power from the power source and for providing a regulated power to the LED string 312. In the example of FIG. 4, the power converter 310 can be a buck converter including an inductor L1, a diode D4, and a control switch Q16. In the embodiment shown in FIG. 4, the control switch Q16 is implemented outside the dimming controller 308. In another embodiment, the control switch Q16 can be integrated in the dimming controller 308.

A dimming controller 308 is operable for receiving a switch monitoring signal indicative of an operation of a power switch 304, and for adjusting the regulated power from the power converter 310 by controlling the control switch Q16 coupled in series with the LED string 312 according to the switch monitoring signal. The light source driving circuit 400 can further include an AC/DC converter 306 for converting an AC input voltage Vin to a DC output voltage Vout, and a current sensor 314 for sensing an LED current flowing through the LED string 312. In the example of FIG. 4, the AC/DC converter 306 can be a bridge rectifier including diodes D1, D2, D7, D8, D10, and a capacitor C9. The current sensor 314 can include a current sensing resistor R5.

In one embodiment, the dimming controller 308 has terminals HV_GATE, SEL, CLK, RT, VDD, CTRL, MON and GND. The terminal HV_GATE is coupled to a switch Q27 through a resistor R3 for controlling a conductance status, e.g., ON/OFF status, of the switch Q27 coupled to the LED string 312. A capacitor 011 is coupled between the terminal HV_GATE and ground for providing a gate voltage of the switch Q27.

A user can select a dimming mode, e.g., an analog dimming mode or a burst dimming mode, by coupling the terminal SEL to ground through a resistor R4 (as shown in FIG. 4), or coupling the terminal SEL to ground directly.

The terminal CLK is coupled to the AC/DC converter 306 through a resistor R3, and is coupled to ground through a resistor R6. The terminal CLK can receive a switch monitoring signal indicating an operation of the power switch 304. In one embodiment, the switch monitoring signal can be generated at a common node between the resistor R3 and the resistor R6. A capacitor C12 is coupled to the resistor R6 in parallel for filtering undesired noises. The terminal RT is coupled to ground through a resistor R7 for determining a frequency of a pulse signal generated by the dimming controller 308.

The terminal VDD is coupled to the switch Q27 through a diode D9 for supplying power to the dimming controller 308. In one embodiment, an energy storage unit, e.g., a capacitor C10, coupled between the terminal VDD and ground can power the dimming controller 308 when the power switch 304 is turned off. In an alternate embodiment, the energy storage unit can be integrated in the dimming controller 308. The terminal GND is coupled to ground.

The terminal CTRL is coupled to the control switch Q16. The control switch Q16 is coupled in series with the LED string 312 and the switch Q27, and is coupled to ground through the current sensing resistor R5. The dimming controller 308 is operable for adjusting the regulated power from the power converter 310 by controlling a conductance status, e.g., ON and OFF status, of the control switch Q16 using a control signal via the terminal CTRL. The terminal MON is coupled to the current sensing resistor R5 for receiving a current monitoring signal indicating an LED current flowing through the LED string 312. When the switch Q27 is turned on, the dimming controller 308 can adjust the LED current flowing through the LED string 312 to ground by controlling the control switch Q16.

In operation, when the power switch 304 is turned on, the AC/DC converter 306 converts an input AC voltage Vin to a DC voltage Vout. A predetermined voltage at the terminal HV_GATE is supplied to the switch Q27 through the resistor R3 so that the switch Q27 is turned on.

If the dimming controller 308 turns on the control switch Q16, the DC voltage Vout powers the LED string 312 and charges the inductor L1. An LED current flows through the inductor L1, the LED string 312, the switch Q27, the control switch Q16, the current sensing resistor R5 to ground. If the dimming controller 308 turns off the control switch Q16, an LED current flows through the inductor L1, the LED string 312, and the diode D4. The inductor L1 is discharged to power the LED string 312. As such, the dimming controller 308 can adjust the regulated power from the power converter 310 by controlling the control switch Q16.

When the power switch 304 is turned off, the capacitor C10 is discharged to power the dimming controller 308. A voltage across the resistor R6 drops to zero. Therefore, a switch monitoring signal indicating a turn-off operation of the power switch 304 can be detected by the dimming controller 308 through the terminal CLK. Similarly, when the power switch 304 is turned on, the voltage across the resistor R6 rises to a predetermined voltage. Therefore, a switch monitoring signal indicating a turn-on operation of the power switch 304 can be detected by the dimming controller 308 through the terminal CLK. If a turn-off operation is detected, the dimming controller 308 turns off the switch Q27 by pulling the voltage at the terminal HV_GATE to zero such that the LED string 312 can be turned off after the inductor L1 completes discharging. In response to the turn-off operation, the dimming controller 308 can adjust a reference signal indicating a target light output of the LED string 312. Therefore, when the power switch 304 is turned on next time, the LED string 312 can generate a light output according to the adjusted target light output. In other words, the light output of the LED string 312 can be adjusted by the dimming controller 308 in response to the turn-off operation of the power switch 304.

Figure 5:
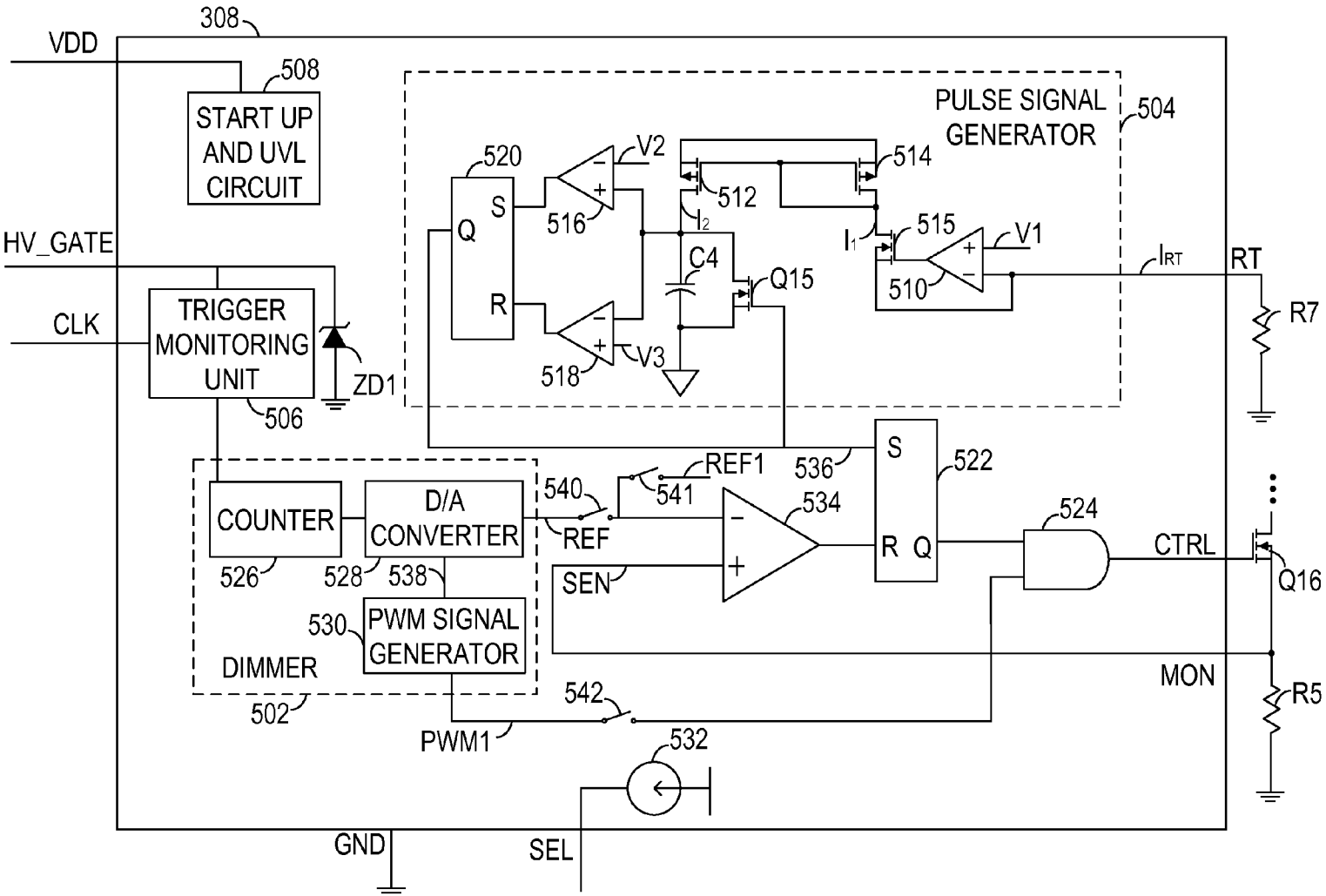
FIG. 5 shows a structure of a dimming controller in FIG. 4, in accordance with one embodiment of the present invention.

FIG. 5 shows an example of a structure of the dimming controller 308 in FIG. 4, in accordance with one embodiment of the present invention. FIG. 5 is described in combination with FIG. 4. Elements labeled the same as in FIG. 4 have similar functions.

The dimming controller 308 includes a trigger monitoring unit 506, a dimmer 502, and a pulse signal generator 504. The trigger monitoring unit 506 is coupled to ground through a Zener diode ZD1. The trigger monitoring unit 506 can receive a switch monitoring signal indicating an operation of the external power switch 304 through the terminal CLK and can generate a driving signal for driving a counter 526 when an operation of the external power switch 304 is detected at the terminal CLK. The trigger monitoring unit 506 is further operable for controlling a conductance status of the switch Q27. The dimmer 502 is operable for generating a reference signal REF to adjust power of the LED string 312 in an analog dimming mode, or generating a control signal 538 for adjusting a duty cycle of a pulse-width modulation signal PWM1 to adjust the power of the LED string 312. The pulse signal generator 504 is operable for generating a pulse signal which can turn on a control switch Q16. The dimming controller 308 can further include a start up and under voltage lockout (UVL) circuit 508 coupled to the terminal VDD for selectively turning on one or more components of the dimming controller 308 according to different power conditions.

In one embodiment, the start up and under voltage lockout circuit 508 is operable for turning on all the components of the dimming controller 308 when the voltage at the terminal VDD is greater than a first predetermined voltage. When the power switch 304 is turned off, the start up and under voltage lockout circuit 508 is operable for turning off other components of the dimming controller 308 except the trigger monitoring unit 506 and the dimmer 502 when the voltage at the terminal VDD is less than a second predetermined voltage, in order to save energy. The start up and under voltage lockout circuit 508 is operable for turning off all the components of the dimming controller 308 when the voltage at the terminal VDD is less than a third predetermined voltage. In one embodiment, the first predetermined voltage is greater than the second predetermined voltage, and the second predetermined voltage is greater than the third predetermined voltage. Because the dimming controller 308 can be powered by the capacitor C10 through the terminal VDD, the trigger monitoring unit 506 and the dimmer 502 can still operate for a time period after the power switch 304 is turned off.

In the dimming controller 308, the terminal SEL is coupled to a current source 532. Users can choose a dimming mode by configuring the terminal SEL, e.g., by coupling the terminal SEL directly to ground or coupling the terminal SEL to ground via a resistor. In one embodiment, the dimming mode can be determined by measuring a voltage at the terminal SEL. If the terminal SEL is directly coupled to ground, the voltage at the terminal SEL is approximately equal to zero. Under such condition, a control circuit turns on a switch 540, and turns off switches 541 and 542. Therefore, the dimming controller 308 is enabled to operate in an analog dimming mode and adjusts the power of the LED string 312 (shown in FIG. 4) by adjusting a reference signal REF. In one embodiment, if the terminal SEL is coupled to ground via a resistor R4 (as shown in FIG. 4), the voltage at the terminal SEL is greater than zero. The control circuit thus turns off the switch 540, and turns on the switches 541 and 542. Therefore, the dimming controller 308 is enabled to operate in a burst dimming mode and adjusts the power of the LED string 312

(shown in FIG. 4) by adjusting a duty cycle of a pulse-width modulation signal PWM1. In other words, different dimming modes can be selected by controlling the ON/OFF status of the switch 540, switch 541 and switch 542. The ON/OFF status of the switch 540, switch 541 and switch 542 can be determined by the voltage at the terminal SEL.

The pulse signal generator 504 is coupled to ground through the terminal RT and the resistor R7 for generating a pulse signal 536 for turning on the control switch Q16. The pulse signal generator 504 can have different configurations and is not limited to the configuration as shown in the example of FIG. 5.

In the pulse signal generator 504, the non-inverting input of an operational amplifier 510 receives a predetermined voltage V1. Thus, the voltage of the inverting input of the operational amplifier 510 can be forced to V1. A current IRT flows through the terminal RT and the resistor R7 to ground. A current 11 flowing through a MOSFET 514 and a MOSFET 515 is substantially equal to IRT. Because the MOSFET 514 and a MOSFET 512 constitute a current mirror, a current 12 flowing through the MOSFET 512 is also substantially equal to IRT. The output of a comparator 516 and the output of a comparator 518 are respectively coupled to the S input and the R input of an SR flip-flop 520. The inverting input of the comparator 516 receives a predetermined voltage V2. The non-inverting input of the comparator 518 receives a predetermined voltage V3. V2 is greater than V3, and V3 is greater than zero, in one embodiment. A capacitor C4 is coupled between the MOSFET 512 and ground, and has one end coupled to a common node between the non-inverting input of the comparator 516 and the inverting input of the comparator 518. The Q output of the SR flip-flop 520 is coupled to the switch Q15 and the S input of an SR flip-flop 522. The switch Q15 is coupled in parallel with the capacitor C4. A conductance status, e.g., ON/OFF status, of the switch Q15 can be determined by the Q output of the SR flip-flop 520.

Initially, the voltage across the capacitor C4 is approximately equal to zero which is less than V3. Therefore, the R input of the SR flip-flop 520 receives a digital 1 from the output of the comparator 518. The Q output of the SR flip-flop 520 is set to digital 0, which turns off the switch Q15. When the switch Q15 is turned off, the voltage across the capacitor C4 increases as the capacitor C4 is charged by 12. When the voltage across C4 is greater than V2, the S input of the SR flip-flop 520 receives a digital 1 from the output of the comparator 516. The Q output of the SR flip-flop 520 is set to digital 1, which turns on the switch Q15. When the switch Q15 is turned on, the voltage across the capacitor C4 decreases as the capacitor C4 discharges through the switch Q15. When the voltage across the capacitor C4 drops below V3, the comparator 518 outputs a digital 1, and the Q output of the SR flip-flop 520 is set to digital 0, which turns off the switch Q15. Then, the capacitor C4 is charged by 12 again. As such, through the process described above, the pulse signal generator 504 can generate a pulse signal 536 which includes a series of pulses at the Q output of the SR flip-flop 520. The pulse signal 536 is sent to the S input of the SR flip-flop 522.

The trigger monitoring unit 506 is operable for monitoring an operation of the power switch 304 through the terminal CLK, and is operable for generating a driving signal for driving the counter 526 when an operation of the power switch 304 is detected at the terminal CLK. In one embodiment, when the power switch 304 is turned on, the voltage at the terminal CLK rises to a level that is equal to a voltage across the resistor R6 (shown in FIG. 4). When the power switch 304 is turned off, the voltage at the terminal CLK drops to zero. Therefore, a switch monitoring signal indicating the operation of the power switch 304 can be detected at the terminal CLK. In one embodiment, the trigger monitoring unit 506 generates a driving signal when a turn-off operation is detected at the terminal CLK.

The trigger monitoring unit 506 is further operable for controlling a conductance status of the switch Q27 through the terminal HV_GATE. When the power switch 304 is turned on, a breakdown voltage across the Zener diode ZD1 is applied to the switch Q27 through the resistor R3. Therefore, the switch Q27 can be turned on. The trigger monitoring unit 506 can turn off the switch Q27 by pulling the voltage at the terminal HV_GATE to zero. In one embodiment, the trigger monitoring unit 506 turns off the switch Q27 when a turn-off operation of the power switch 304 is detected at the terminal CLK, and turns on the switch Q27 when a turn-on operation of the power switch 304 is detected at the terminal CLK.

In one embodiment, the dimmer 502 includes a counter 526 coupled to the trigger monitoring unit 506 for counting operations of the power switch 304, a digital-to-analog converter (D/A converter) 528 coupled to the counter 526. The dimmer 502 can further include a pulse-width modulation (PWM) signal generator 530 coupled to the D/A converter 528. The counter 526 is driven by the driving signal generated by the trigger monitoring unit 506. More specifically, when the power switch 304 is turned off, the trigger monitoring unit 506 detects a negative falling edge of the voltage at the terminal CLK and generates a driving signal, in one embodiment. The counter value of the counter 526 can be increased, e.g., by 1, in response to the driving signal. The D/A converter 528 reads the counter value from the counter 526 and generates a dimming signal (e.g., control signal 538 or reference signal REF) based on the counter value. The dimming signal can be used to adjust a target power level of the power converter 310, which can in turn adjust the light output of the LED string 312.

In the burst dimming mode, the switch 540 is off, the switch 541 and the switch 542 are on. The inverting input of the comparator 534 receives a reference signal REF1 which can be a DC signal having a predetermined substantially constant voltage. In the example of FIG. 5, the voltage of REF1 determines a peak value of the LED current, which in turn determines the maximum light output of the LED string 312. The dimming signal can be a control signal 538 which is applied to the pulse-width modulation signal generator 530 for adjusting a duty cycle of the pulse-width modulation signal PWM1. By adjusting the duty cycle of PWM1, the light output of the LED string 312 can be adjusted no greater than the maximum light output determined by REF1. For example, if PWM1 has a duty cycle of 100%, the LED string 312 can have the maximum light output. If the duty cycle of PWM1 is less than 100%, the LED string 312 can have a light output that is lower than the maximum light output.

In the analog dimming mode, the switch 540 is on, the switch 541 and the switch 542 are off, and the dimming signal can be an analog reference signal REF having an adjustable voltage. The D/A converter 528 can adjust the voltage of the reference signal REF according to the counter value of the counter 526. In the example of FIG. 5, the voltage of REF determines a peak value of the LED current, which in turn determines an average value of the LED current. As such, the light output of the LED string 312 can be adjusted by adjusting the reference signal REF.

In one embodiment, the D/A converter 528 can decrease the voltage of REF in response to an increase of the counter value. For example, if the counter value is 0, the D/A converter 528 adjusts the reference signal REF to have a voltage V4. If the counter value is increased to 1 when a turn-off operation of the power switch 304 is detected at the terminal CLK by the trigger monitoring unit 506, the D/A converter 528 adjusts the reference signal REF to have a voltage V5 that is less than V4. Yet in another embodiment, the D/A converter 528 can increase the voltage of REF in response to an increase of the counter value.

In one embodiment, the counter value is reset to zero after the counter 526 reaches its maximum counter value. For example, if the counter 526 is a 2-bit counter, the counter value will increase from 0 to 1, 2, 3 and then return to zero after four turn-off operations have been detected. Accordingly, the light output of the LED string 312 can be adjusted from a first level to a second level, then to a third level, then to a fourth level, and then back to the first level.

The inverting input of a comparator 534 can selectively receive the reference signal REF and the reference signal REF1. For example, the inverting input of the comparator 534 receives the reference signal REF through the switch 540 in the analog dimming mode, and receives the reference signal REF1 through the switch 541 in the burst dimming mode. The non-inverting input of the comparator 534 is coupled to the resistor R5 through the terminal MON for receiving a current monitoring signal SEN from the current sensing resistor R5. The voltage of the current monitoring signal SEN can indicate an LED current flowing through the LED string 312 when the switch Q27 and the control switch Q16 are turned on.

The output of the comparator 534 is coupled to the R input of the SR flip-flop 522. The Q output of the SR flip-flop 522 is coupled to an AND gate 524. The pulse-width modulation signal PWM1 generated by the pulse-width modulation signal generator 530 is provided to the AND gate 524. The AND gate 524 outputs a control signal to control the control switch Q16 through the terminal CTRL.

If the analog dimming mode is selected, the switch 540 is turned on and the switches 541 and 542 are turned off. The control switch Q16 is controlled by the SR flip-flop 522. In operation, when the power switch 304 is turned on, the breakdown voltage across the Zener diode ZD1 turns on the switch Q27. The SR flip-flop 522 generates a digital 1 at the Q output to turn on the control switch Q16 in response to the pulse signal 536 generated by the pulse generator 504. An LED current flowing through the inductor L1, the LED string 312, the switch Q27, the control switch Q16, the current sensing resistor R5 to ground. The LED current gradually increases because the inductor resists a sudden change of the LED current. As a result, the voltage across the current sensing resistor R5, that is, the voltage of the current monitoring signal SEN can be increased. When the voltage of SEN is greater than that of the reference signal REF, the comparator 534 generates a digital 1 at the R input of the SR flip-flop 522 so that the SR flip-flop 522 generates a digital 0 to turn off the control switch Q16. After the control switch Q16 is turned off, the inductor L1 is discharged to power the LED string 312. An LED current which flows through the inductor L1, the LED string 312, and the diode D4 gradually decreases. The control switch Q16 is turned on when the SR flip-flop 522 receives a pulse at the S input again, and then the LED current flows through the current sensing resistor R5 to ground again. When the voltage of the current monitoring signal SEN is greater than that of the reference signal REF, the control switch Q16 is turned off by the SR flip-flop 522. As described above, the reference signal REF determines a peak value of the LED current, which can in turn determine the light output of the LED string 312. By adjusting the reference signal REF, the light output of the LED string 312 is adjusted.

In the analog dimming mode, the counter value of the counter 526 can be increased by 1 when the trigger monitoring unit 506 detects a turn-off operation of the power switch 304 at the terminal CLK. The trigger monitoring unit 506 can turn off the switch Q27 in response to the turn-off operation of the power switch 304. The D/A converter 528 can adjust the voltage of the reference signal REF from a first level to a second level in response to the change of the counter value. Therefore, the light output of the LED string 312 can be adjusted in accordance with the adjusted reference signal REF when the power switch 304 is turned on.

If the burst dimming mode is selected, the switch 540 is turned off and the switches 541 and 542 are turned on. The inverting input of the comparator 534 receives a reference signal REF1 having a predetermined voltage. The control switch Q16 is controlled by both of the SR flip-flop 522 and the pulse-width modulation signal PWM1 through the AND gate 524. In the example of FIG. 5, the reference signal REF1 determines a peak value of the LED current, which in turn determines a maximum light output of the LED string 312. The duty cycle of the pulse-width modulation signal PWM1 can determine the on/off time of the control switch Q16. When the pulse-width modulation signal PWM1 is logic 1, the conductance status of the control switch Q16 is determined by the Q output of the SR flip-flop 522. When the pulse-width modulation signal PWM1 is logic 0, the control switch Q16 is turned off. By adjusting the duty cycle of the pulse-width modulation signal PWM1, the power of the LED string 312 can be adjusted accordingly. As such, the combination of the reference signal REF1 and the pulse-width modulation signal PWM1 can determine the light output of the LED string 312.

In the burst dimming mode, a turn-off operation of the power switch 304 can be detected by the trigger monitoring unit 506 at the terminal CLK. The trigger monitoring unit 506 turns off the switch Q27 and generates a driving signal. The counter value of the counter 526 can be increased, e.g., by 1, in response of the driving signal. The D/A converter 528 can generate the control signal 538 to adjust the duty cycle of the pulse-width modulation signal PWM1 from a first level to a second level. Therefore, when the power switch 304 is turned on next time, the light output of the LED string 312 can be adjusted to follow a target light output which is determined by the reference signal REF1 and the pulse-width modulation signal PWM1.

Figure 6:
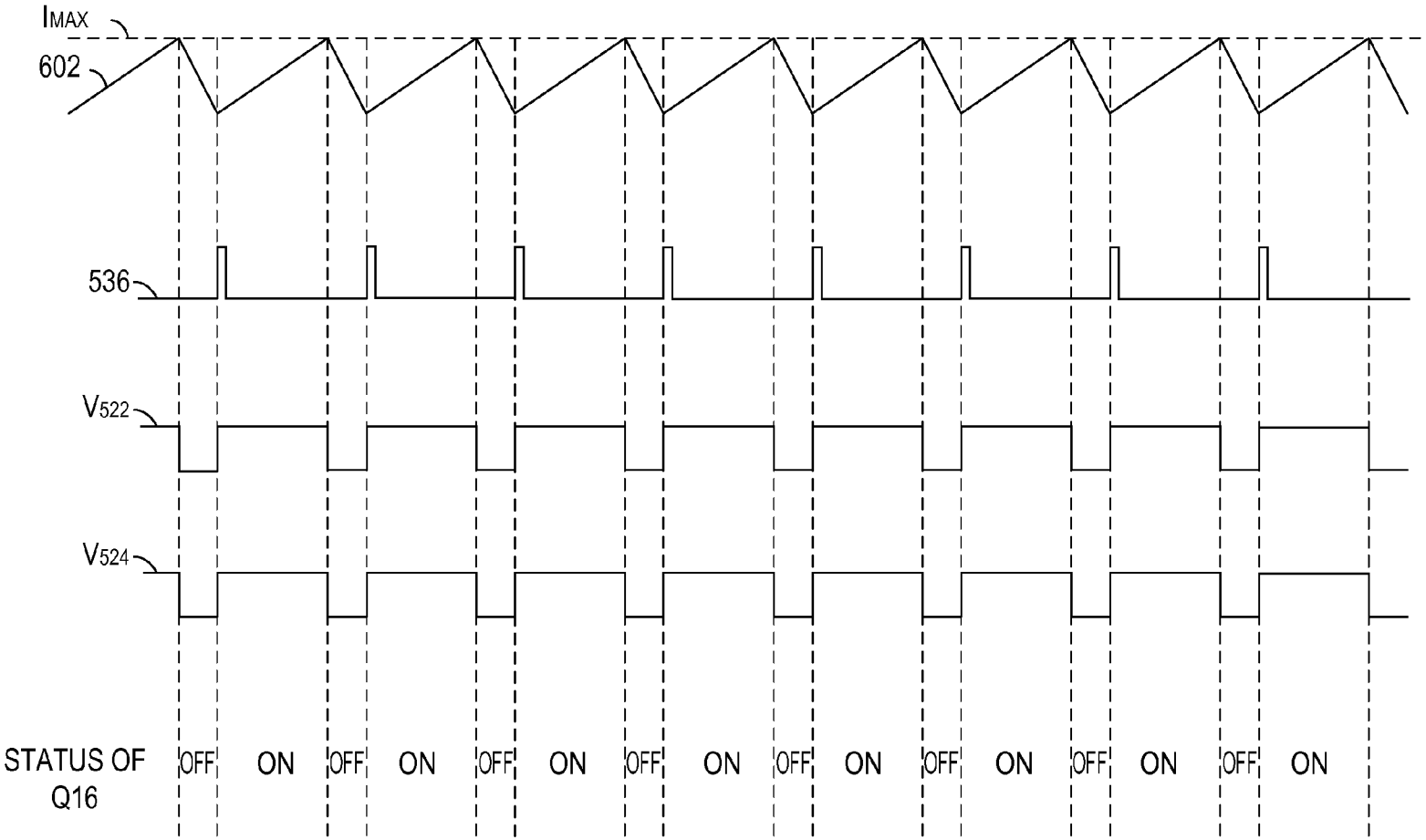
FIG. 6 illustrates signal waveforms in the analog dimming mode, in accordance with one embodiment of the present invention.

FIG. 6 illustrates examples of signal waveforms of an LED current 602 flowing through the LED string 312, the pulse signal 536, V522 which indicates the output of the SR flip-flop 522, V524 which indicates the output of the AND gate 524, and the ON/OFF status of the control switch Q16 in the analog dimming mode. FIG. 6 is described in combination with FIG. 4 and FIG. 5.

In operation, the pulse signal generator 504 generates pulse signal 536. The SR flip-flop 522 generates a digital 1 at the Q output in response to each pulse of the pulse signal 536. The control switch Q16 is turned on when the Q output of the SR flip-flop 522 is digital 1. When the control switch Q16 is turned on, the inductor L1 ramps up and the LED current 602 increases. When the LED current 602 reaches the peak value Imax, which means the voltage of the current monitoring signal SEN is substantially equal to the voltage of the reference signal REF, the comparator 534 generates a digital 1 at the R input of the SR flip-flop 522 so that the SR flip-flop 522 generates a digital 0 at the Q output. The control switch Q16 is turned off when the Q output of the SR flip-flop 522 is digital 0. When the control switch Q16 is turned off, the inductor L1 is discharged to power the LED string 312 and the LED current 602 decreases. In this analog dimming mode, by adjusting the reference signal REF, the average LED current can be adjusted accordingly and therefore the light output of the LED string 312 can be adjusted.

Figure 7:
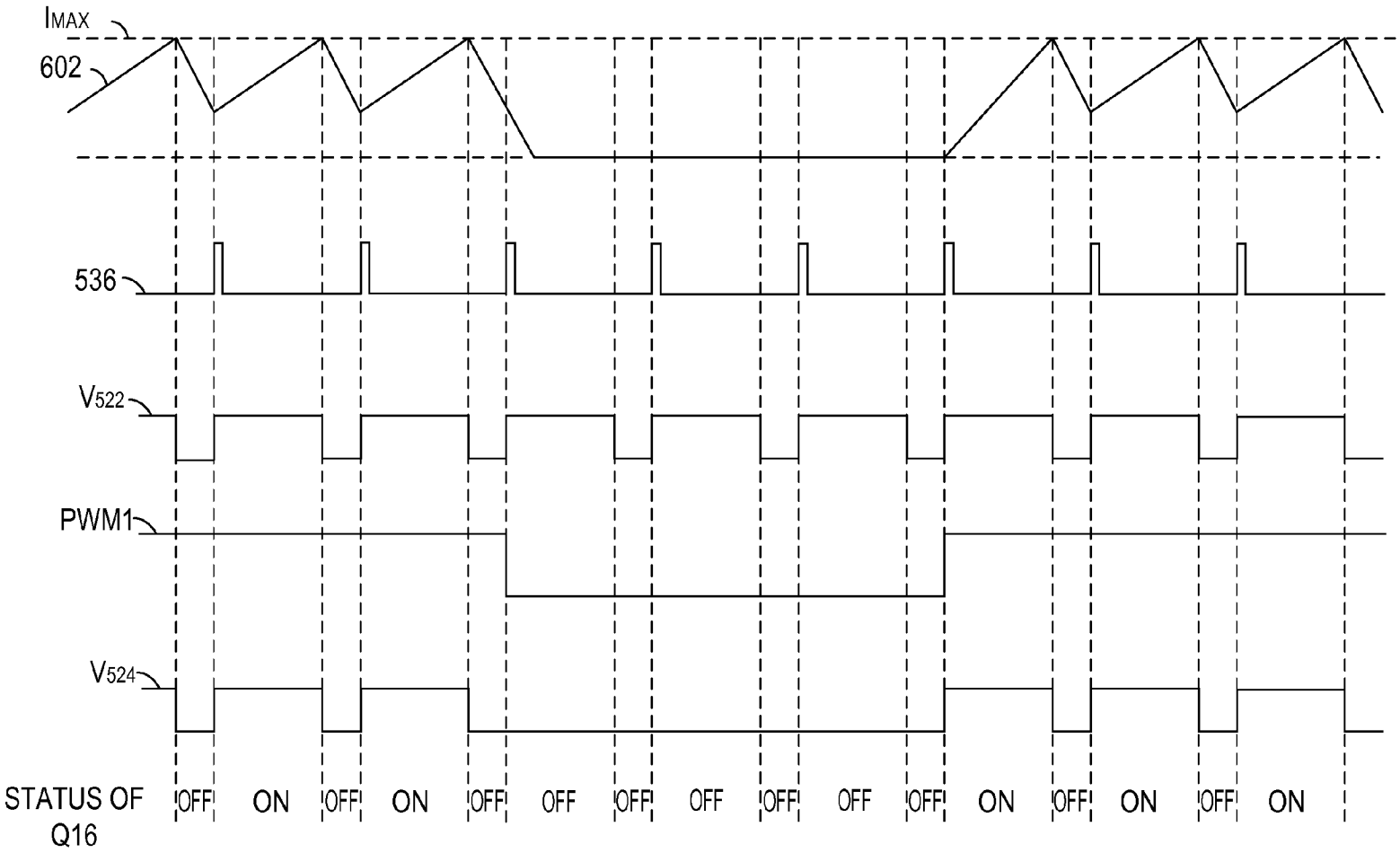
FIG. 7 illustrates signal waveforms in the burst dimming mode, in accordance with one embodiment of the present invention.

FIG. 7 illustrates examples of signal waveforms of the LED current 602 flowing through the LED string 312, the pulse signal 536, V522 which indicates the output of the SR flip-flop 522, V524 which indicates the output of the AND gate 524, and the ON/OFF status of the control switch Q16, and the PMW signal PWM1 in the burst dimming mode. FIG. 7 is described in combination with FIG. 4 and FIG. 5.

When PWM1 is digital 1, the relationship among the LED current 602, the pulse signal 536, V522, V524, and the ON/OFF status of the switch Q1 is similar to that is illustrated in FIG. 6. When PWM1 is digital 0, the output of the AND gate 524 turns to digital 0. Therefore, the control switch Q16 is turned off and the LED current 602 decreases. If the PWM1 holds digital 0 long enough, the LED current 602 can fall to zero. In this burst dimming mode, by adjusting the duty cycle of PWM1, the average LED current can be adjusted accordingly and therefore the light output of the LED string 312 can be adjusted.

Figure 8:
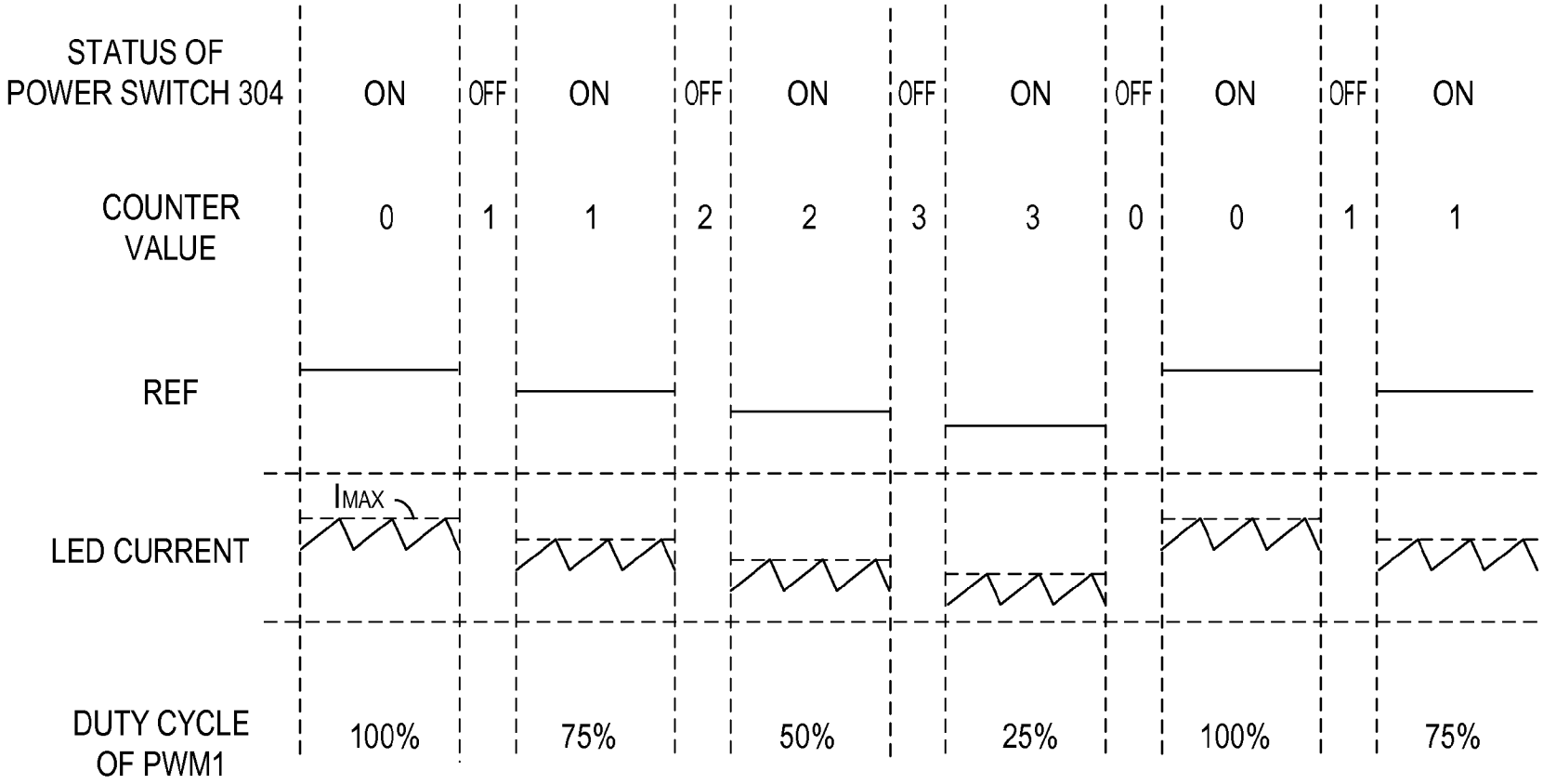
FIG. 8 shows a diagram illustrating an operation of a light source driving circuit which includes the dimming controller in FIG. 5, in accordance with one embodiment of the present invention.

FIG. 8 shows an example of a diagram illustrating an operation of a light source driving circuit which includes the dimming controller in FIG. 5, in accordance with one embodiment of the present invention. FIG. 8 is described in combination with FIG. 5.

In the example shown in FIG. 8, each time when a turn-off operation of the power switch 304 is detected by the trigger monitoring unit 506, the counter value of the counter 526 is increases by 1. The counter 526 can be a 2-bit counter which has a maximum counter value of 3.

In the analog dimming mode, the D/A converter 528 reads the counter value from the counter 526 and decreases the voltage of the reference signal REF in response to an increase of the counter value. The voltage of REF can determine a peak value Imax of the LED current, which can in turn determine an average value of the LED current. In the burst dimming mode, the D/A converter 528 reads the counter value from the counter 526 and decreases the duty cycle of the pulse-width modulation signal PWM1 (e.g., decreases 25% each time) in response to an increase of the counter value. The counter 526 is reset after it reaches its maximum counter value (e.g., 3).

Figure 9:
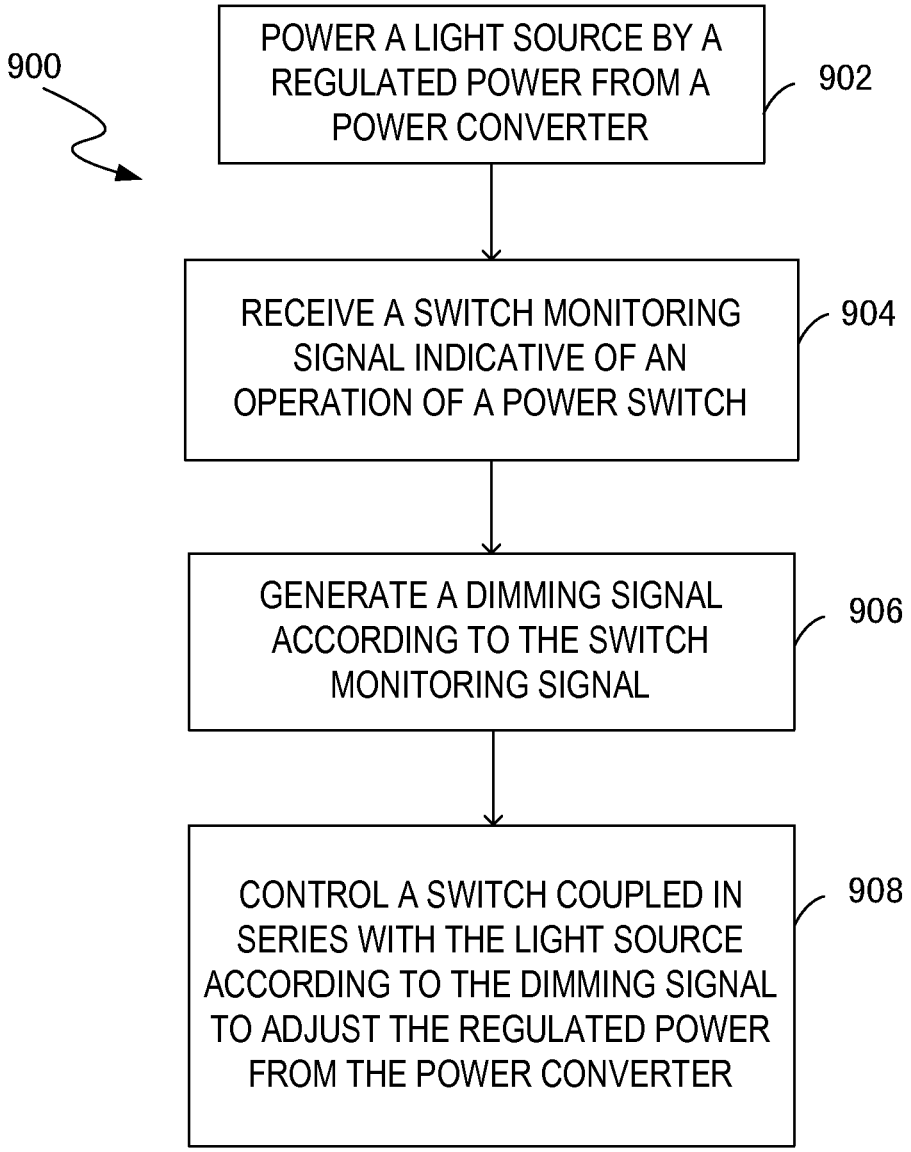
FIG. 9 shows a flowchart of a method for adjusting power of a light source, in accordance with one embodiment of the present invention.

FIG. 9 shows a flowchart 900 of a method for adjusting power of a light source, in accordance with one embodiment of the present invention. FIG. 9 is described in combination with FIG. 4 and FIG. 5.

In block 902, a light source, e.g., the LED string 312, is powered by a regulated power from a power converter, e.g., the power converter 310. In block 904, a switch monitoring signal can be received, e.g., by the dimming controller 308. The switch monitoring signal can indicate an operation of a power switch, e.g., the power switch 304 coupled between a power source and the power converter. In block 906, a dimming signal is generated according to the switch monitoring signal. In block 908, a switch coupled in series with the light source, e.g., the control switch Q16, is controlled according to the dimming signal so as to adjust the regulated power from the power converter. In one embodiment, in an analog dimming mode, the regulated power from the power converter can be adjusted by comparing the dimming signal with a feedback current monitoring signal which indicates a light source current of the light source. In another embodiment, in a burst dimming mode, the regulated power from the power converter can be adjusted by controlling a duty cycle of a pulse-width modulation signal by the dimming signal.

Accordingly, embodiments in accordance with the present invention provide a light source driving circuit that can adjust power of a light source according to a switch monitoring signal indicative of an operation of a power switch, e.g., an on/off switch mounted on the wall. The power of the light source, which is provided by a power converter, can be adjusted by a dimming controller by controlling a switch coupled in series with the light source. Advantageously, as described above, users can adjust the light output of the light source through an operation (e.g., a turn-off operation) of a low-cost on/off power switch. Therefore, extra apparatus for dimming, such as an external dimmer or a specially designed switch with adjusting buttons, can be avoided and the cost can be reduced.

Figure 10:
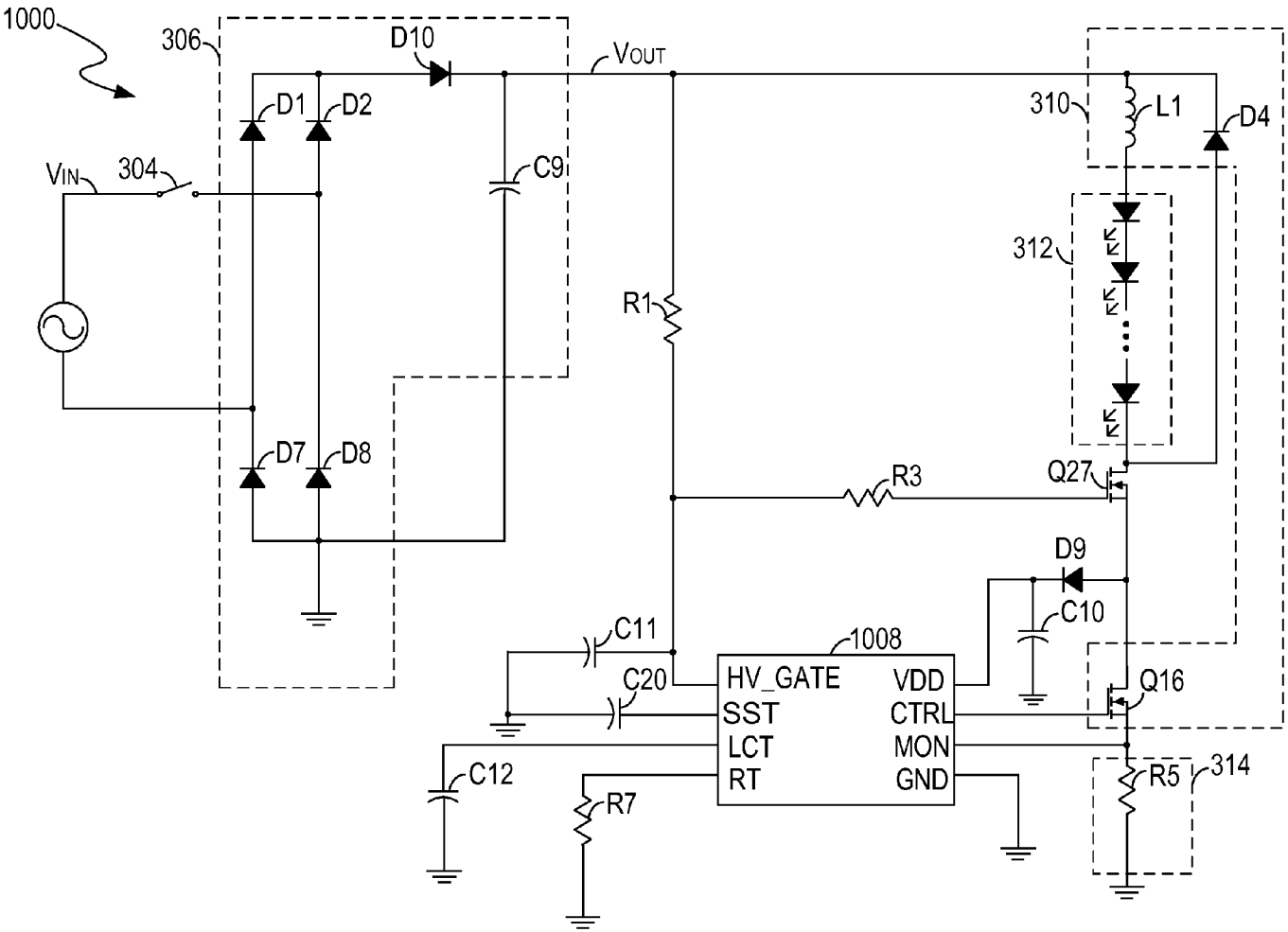
FIG. 10 shows a schematic diagram of a light source driving circuit, in accordance with one embodiment of the present invention.

FIG. 10 shows a schematic diagram of a light source driving circuit 1000, in accordance with one embodiment of the present invention. Elements labeled the same as in FIG. 4 have similar functions. The light source driving circuit 1000 gradually increases the brightness of a light source, e.g., an LED string 312, if a power switch 304 coupled between a power source and the light source driving circuit 1000 is turned on.

In one embodiment, the light source driving circuit 1000 includes a power converter 310 and a dimming controller 1008. The power converter 310 is coupled to the power source and the LED string 312. The power converter 310 receives power from the power source and provides a regulated power to the LED string 312. In the example of FIG. 10, the power converter 310 is a buck converter including an inductor L1, a diode D4, and a control switch Q16. In FIG. 10, the control switch Q16 is implemented outside the dimming controller 1008. Alternatively, the control switch Q16 can be integrated in the dimming controller 1008. The dimming controller 1008 is operable for adjusting the regulated power from the power converter 310 by controlling the control switch Q16 coupled in series with the LED string 312. In one embodiment, the dimming controller 1008 is further operable for adjusting a current flowing through the LED string 312 based on a ramp signal, such that an average current flowing through the LED string 312 gradually increases to a predetermined level if the power switch 304 coupled between the power source and the light source driving circuit 1000 is turned on.

The light source driving circuit 1000 can further include an AC/DC converter 306 for converting an AC input voltage Vin to a DC output voltage Vout, and a current sensor 314 for sensing a current flowing through the LED string 312. In the example of FIG. 4, the AC/DC converter 306 is a bridge rectifier including diodes D1, D2, D7, D8, D10, and a capacitor C9. The current sensor 314 can include a current sensing resistor R5.

In the example of FIG. 10, the dimming controller 1008 has terminals HV_GATE, SST, LCT, RT, VDD, CTRL, MON and GND. The terminal HV_GATE is coupled to a switch Q27 through a resistor R3 for controlling a conductance status, e.g., ON/OFF status, of the switch Q27. A capacitor C11 is coupled between the terminal HV_GATE and ground for providing a gate voltage of the switch Q27. The terminal SST is coupled to ground through a capacitor C20 for receiving a ramp signal. The terminal LCT is coupled to ground through a capacitor C12. The terminal RT is coupled to ground through a resistor R7 for determining a frequency of a pulse signal generated by the dimming controller 1008. The terminal VDD is coupled to the switch Q27 through a diode D9 for supplying power to the dimming controller 1008. In one embodiment, an energy storage unit, e.g., a capacitor C10, coupled between the terminal VDD and ground can power the dimming controller 1008 when the power switch 304 is turned off. In an alternate embodiment, the energy storage unit can be integrated in the dimming controller 1008. The terminal GND is coupled to ground.

The terminal CTRL is coupled to the control switch Q16 in series with the LED string 312, the switch Q27, and the current sensing resistor R5. The dimming controller 1008 is operable for adjusting the regulated power from the power converter 310 by controlling a conductance status, e.g., ON and OFF status, of the control switch Q16 using a control signal via the terminal CTRL. The terminal MON is coupled to the current sensing resistor R5 for receiving a current monitoring signal indicating a current flowing through the LED string 312. When the switch Q27 is turned on, the dimming controller 1008 can adjust the current flowing through the LED string 312 by controlling the control switch Q16.

In operation, when the power switch 304 is turned on, the AC/DC converter 306 converts an input AC voltage Vin to a DC voltage Vout. A predetermined voltage at the terminal HV_GATE is supplied to the switch Q27 through the resistor R3 so that the switch Q27 is turned on. If the dimming controller 1008 turns on the control switch Q16, the DC voltage Vout powers the LED string 312 and charges the inductor L1. A current flows through the inductor L1, the LED string 312, the switch Q27, the control switch Q16, the current sensing resistor R5 to ground. If the dimming controller 1008 turns off the control switch Q16, a current flows through the inductor L1, the LED string 312, and the diode D4. The inductor L1 is discharged to power the LED string 312. As such, the dimming controller 1008 can adjust the power from the power converter 310 by controlling the control switch Q16.

Figure 11:
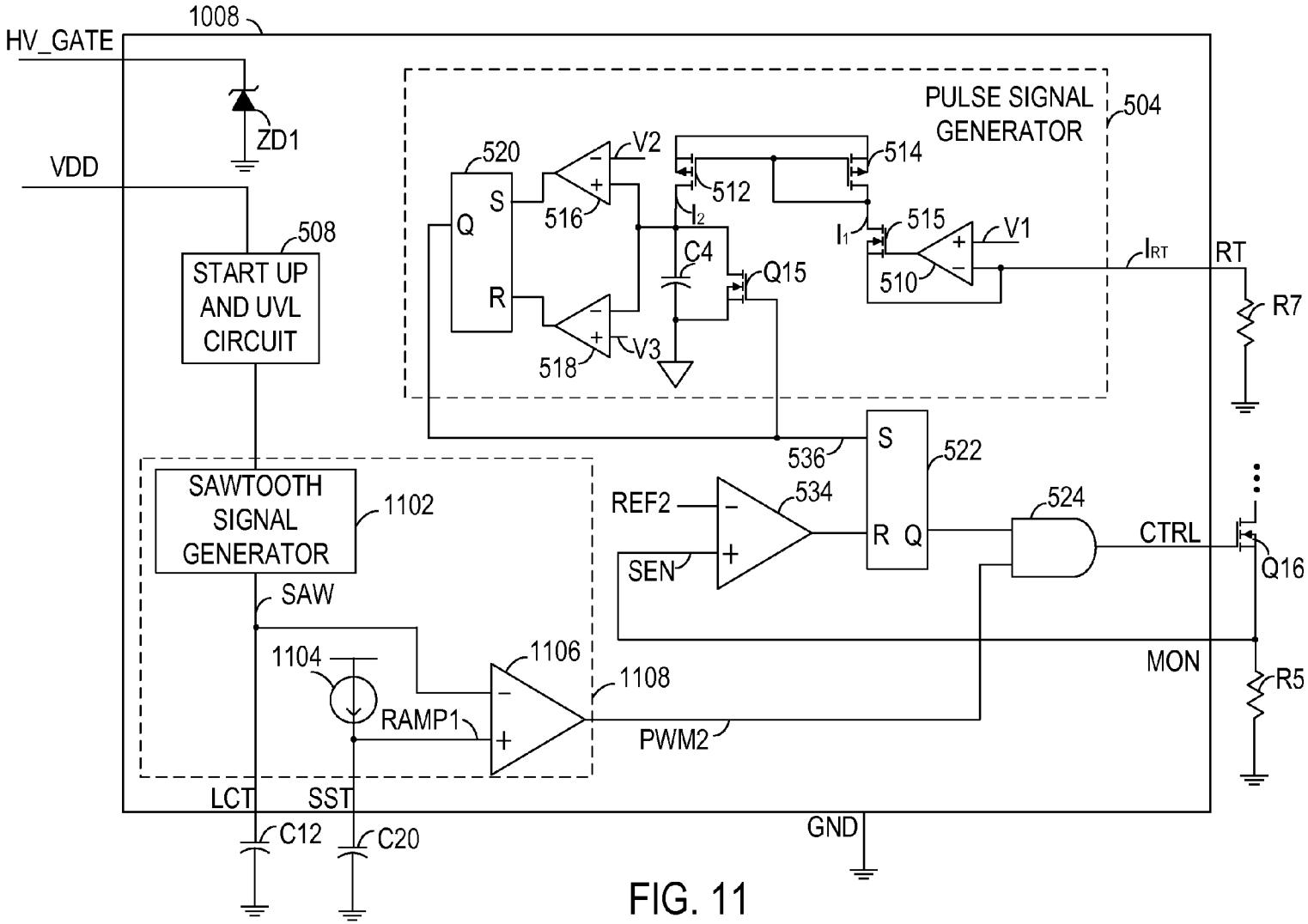
FIG. 11 shows a structure of a dimming controller in FIG. 10, in accordance with one embodiment of the present invention.

FIG. 11 shows a structure of a dimming controller 1008 in FIG. 10, in accordance with one embodiment of the present invention. Elements labeled the same as in FIG. 5 have similar functions.

In the example of FIG. 11, the dimming controller 1008 includes a pulse signal generator 504, a pulse-width modulation signal generator 1108, and a start up and under voltage lockout (UVL) circuit 508. The start up and under voltage lockout circuit 508 can selectively turn on one or more components of the dimming controller 1008 according to different power conditions. The pulse signal generator 504 is operable for generating a pulse signal for turning on the control switch Q16. The pulse-width modulation signal generator 1108 is operable for generating a pulse-width modulation signal PWM2. In one embodiment, the pulse-width modulation signal generator 1108 includes a sawtooth signal generator 1102 for generating a sawtooth signal SAW, a power source 1104 for generating a ramp signal RAMP1, and a comparator 1106 for generating the pulse-width modulation signal PWM2 by comparing the sawtooth signal SAW with the ramp signal RAMP1.

In operation, the pulse signal generator 504 generates a pulse signal 536 which includes a series of pulses at the Q output of the SR flip-flop 520. The pulse signal 536 is sent to the S input of the SR flip-flop 522. The inverting input of the comparator 534 receives a reference signal REF2 which can be a DC signal having a predetermined substantially constant voltage. In the example if FIG. 11, the voltage of REF2 determines a peak value of the LED current, which in turn determines the maximum light output of the LED string 312. The output of the comparator 534 is coupled to the R input of the SR flip-flop 522. The Q output of the SR flip-flop 522 is coupled to an AND gate 524. The pulse-width modulation signal PWM2 generated by the pulse-width modulation signal generator 1108 is provided to the AND gate 524. The AND gate 524 outputs a control signal to control the control switch Q16 through the terminal CTRL. In one embodiment, when the pulse-width modulation signal PWM2 is logic 1, the conductance status of the control switch Q16 is determined by the Q output of the SR flip-flop 522; when the pulse-width modulation signal PWM2 is logic 0, the control switch Q16 is turned off. By adjusting the duty cycle of the pulse-width modulation signal PWM2, the power of the LED string 312 can be adjusted accordingly. As such, the combination of the reference signal REF2 and the pulse-width modulation signal PWM2 can determine the brightness of the LED string 312.

Figure 12:
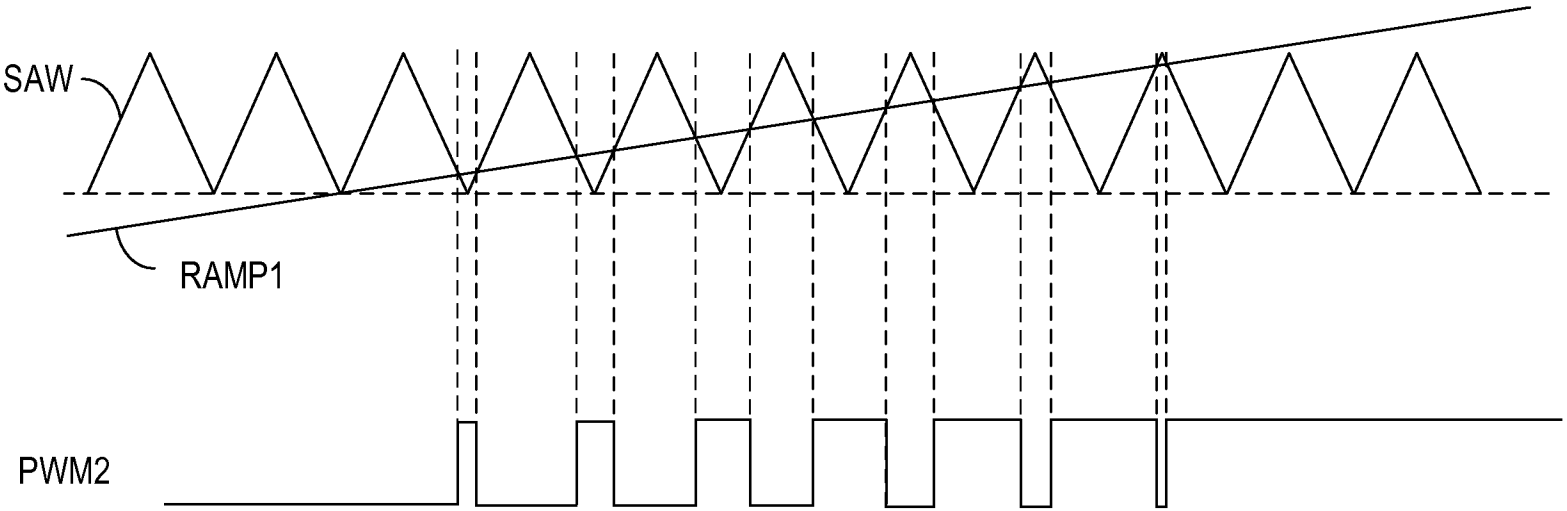
FIGS. 12-13 shows signal waveforms of signals associated with a light source driving circuit which includes a diming controller in FIG. 11, in accordance with one embodiment of the present invention.
Figure 13:
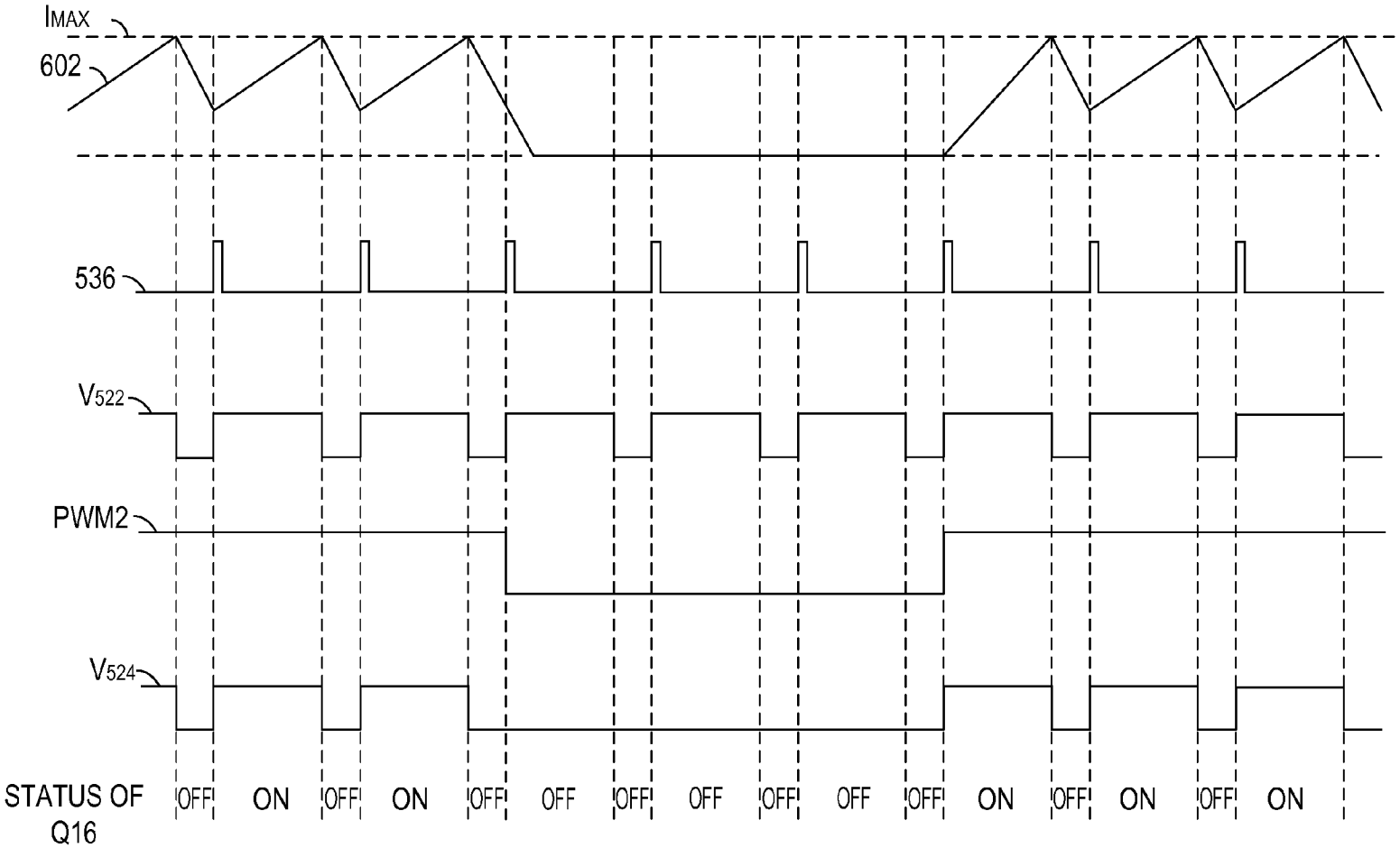

FIGS. 12-13 show signal waveforms of signals associated with a light source driving circuit which includes the dimming controller 1008 in FIG. 11, in accordance with one embodiment of the present invention. FIG. 12 shows waveforms of the sawtooth signal SAW, the ramp signal RAMP1, and the pulse-width modulation signal PWM2. FIG. 13 shows waveforms of the current 602 flowing through the LED string 312, the pulse signal 536, the output V522 of the SR flip-flop 522, the output V524 of the AND gate 524, the ON/OFF status of the control switch Q16, and the pulse-width modulation signal PWM2. FIG. 12 and FIG. 13 are described in combination with FIG. 10 and FIG. 11.

When the power switch 304 is turned on, the dimming controller 1008 is supplied with power through the terminal VDD. If the voltage at the terminal VDD is greater than a predetermined voltage, the power source 1104 is enabled by the start up and under voltage lockout circuit 508 to charge a capacitor C20 through the terminal SST. As a result, the voltage across the capacitor C20, i.e., the ramp signal RAMP1, gradually increases as shown in FIG. 12. The sawtooth signal generator 1102 generates the sawtooth signal SAW. The comparator 1106 compares the ramp signal RAMP1 with the sawtooth signal SAW to generate the pulse-width modulation signal PWM2. Consequently, if the power switch 304 is turned on, the duty cycle of the pulse-width modulation signal PWM2 increases as the voltage of the ramp signal RAMP1 increases, as shown in FIG. 12.

In operation, the pulse signal generator 504 generates the pulse signal 536. The SR flip-flop 522 generates a digital 1 at the Q output in response to each pulse of the pulse signal 536. If PWM2 is digital 1, the control switch Q16 is turned on when the Q output of the SR flip-flop 522 is digital 1. When the control switch Q16 is turned on, the current through the inductor L1 ramps up and the LED current 602 increases. When the LED current 602 reaches the peak value Imax, which indicates that the voltage of the current monitoring signal SEN reaches the voltage of the reference signal REF2, the comparator 534 generates a digital 1 at the R input of the SR flip-flop 522 so that the SR flip-flop 522 generates a digital 0 at the Q output. The control switch Q16 is turned off when the Q output of the SR flip-flop 522 is digital 0. When the control switch Q16 is turned off, the inductor L1 is discharged to power the LED string 312 and the LED current 602 decreases. If PWM2 is digital 0, the output of the AND gate 524 turns to digital 0. Therefore, the control switch Q16 is turned off and the LED current 602 decreases. If the PWM2 holds digital 0 long enough, the LED current 602 can decrease to zero. As such, if PWM2 is in a first state (e.g., digital 1), the dimming controller 1008 turns on the control switch Q16 in response to the pulse signal 536 and turns off the control switch Q16 if the LED current 602 reaches the peak value Imax. If PWM2 is in a second state (e.g., digital 0), the dimming controller 1008 keeps the control switch Q16 off. As described above, the duty cycle of PWM2 can determine an average current flowing through the LED string 312. As shown in the example of FIG. 12, if the power switch 304 is turned on, the duty cycle of PWM2 gradually increases as the voltage of the ramp signal RAMP1 increases until the duty cycle reaches 100%. As a result, the average current flowing through the LED string 312 gradually increases such that the brightness of the LED string 312 gradually increases.

Figure 14:
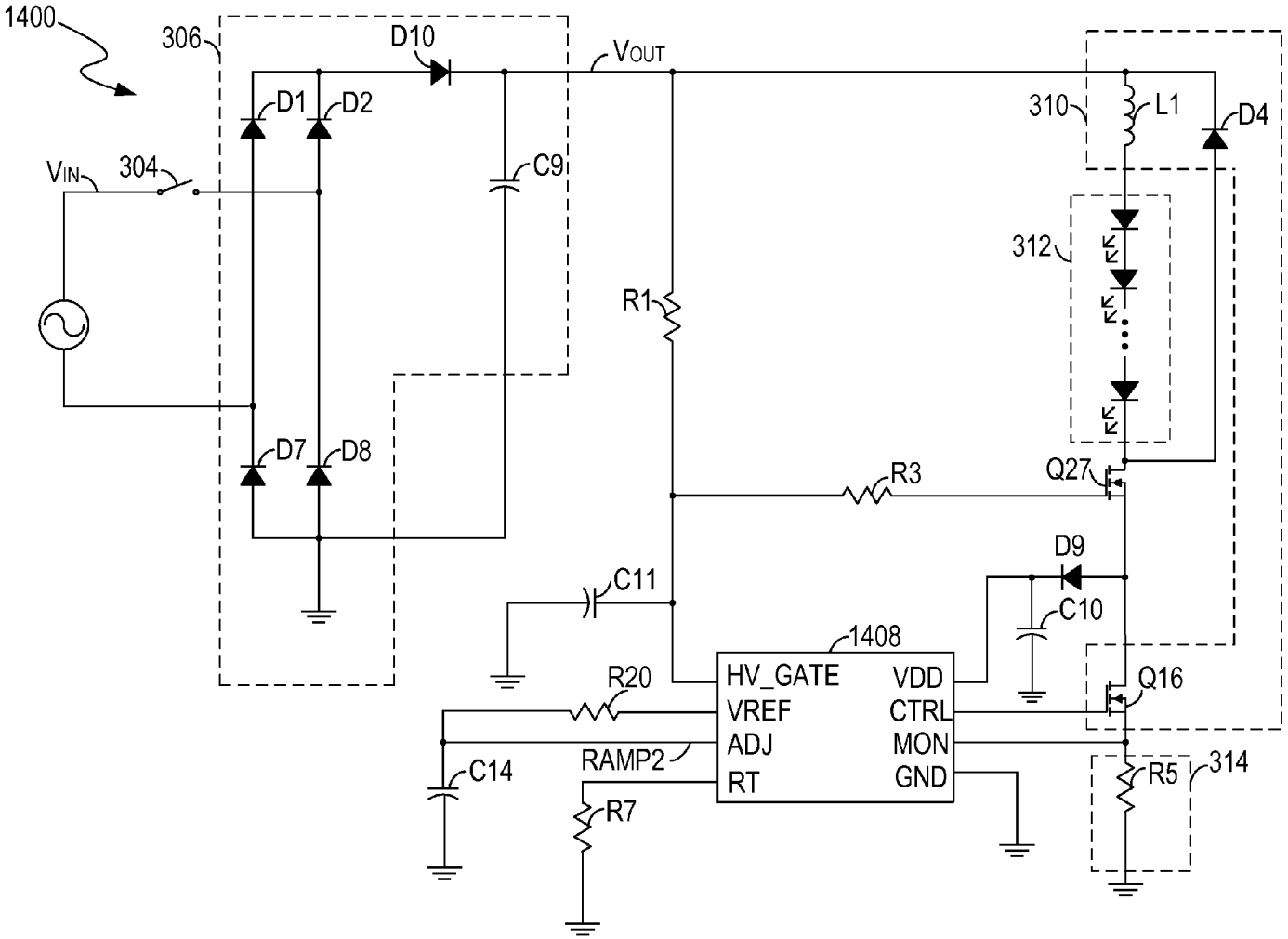
FIG. 14 shows a schematic diagram of a light source driving circuit, in accordance with one embodiment of the present invention.

FIG. 14 shows a schematic diagram of a light source driving circuit 1400, in accordance with one embodiment of the present invention. Elements labeled the same as in FIG. 10 have similar functions. The light source driving circuit 1400 gradually increases the brightness of a light source, e.g., an LED string 312, if a power switch 304 coupled between a power source and the light source driving circuit 1400 is turned on.

In one embodiment, the light source driving circuit 1400 includes a power converter 310 and a dimming controller 1408. The power converter 310 is coupled to the power source and the LED string 312 for receiving power from the power source and for providing a regulated power to the LED string 312. In the example of FIG. 14, the power converter 310 is a buck converter including an inductor L1, a diode D4, and a control switch Q16. In the embodiment shown in FIG. 14, the control switch Q16 is implemented outside the dimming controller 1408. Alternatively, the control switch Q16 can be integrated in the dimming controller 1408. The dimming controller 1408 is operable for adjusting the regulated power from the power converter 310 by controlling the control switch Q16 coupled in series with the LED string 312. In one embodiment, the dimming controller 1408 is further operable for adjusting a current flowing through the LED string 312 based on a ramp signal, such that an average current flowing through the LED string 312 gradually increases to a predetermined level if the power switch 304 coupled between the power source and the light source driving circuit 1400 is turned on.

The light source driving circuit 1400 can further include an AC/DC converter 306 for converting an AC input voltage Vin to a DC output voltage Vout, and a current sensor 314 for sensing an LED current flowing through the LED string 312. In the example of FIG. 4, the AC/DC converter 306 is a bridge rectifier including diodes D1, D2, D7, D8, D10, and a capacitor C9. The current sensor 314 can include a current sensing resistor R5.

In one embodiment, the dimming controller 1408 has terminals HV_GATE, VREF, ADJ, RT, VDD, CTRL, MON and GND. The terminal HV_GATE is coupled to a switch Q27 through a resistor R3 for controlling a conductance status, e.g., ON/OFF status, of the switch Q27 coupled to the LED string 312. A capacitor C11 is coupled between the terminal HV_GATE and ground for providing a gate voltage of the switch Q27. The terminal VREF is coupled to ground through a resistor R20 and an energy storage element (e.g., a capacitor C14). The terminal VREF provides a DC voltage to charge the capacitor C14 to generate a ramp signal RAMP2. The terminal ADJ is coupled to the capacitor C14 for receiving the ramp signal RAMP2. The terminal RT is coupled to ground through a resistor R7 for determining a frequency of a pulse signal generated by the dimming controller 1408. The terminal VDD is coupled to the switch Q27 through a diode D9 for supplying power to the dimming controller 1408. In one embodiment, an energy storage unit, e.g., a capacitor C10, coupled between the terminal VDD and ground can power the dimming controller 1408 when the power switch 304 is turned off. In an alternate embodiment, the energy storage unit can be integrated in the dimming controller 1408. The terminal GND is coupled to ground. The dimming controller 1408 can adjust the regulated power from the power converter 310 by controlling the control switch Q16.

Figure 15:
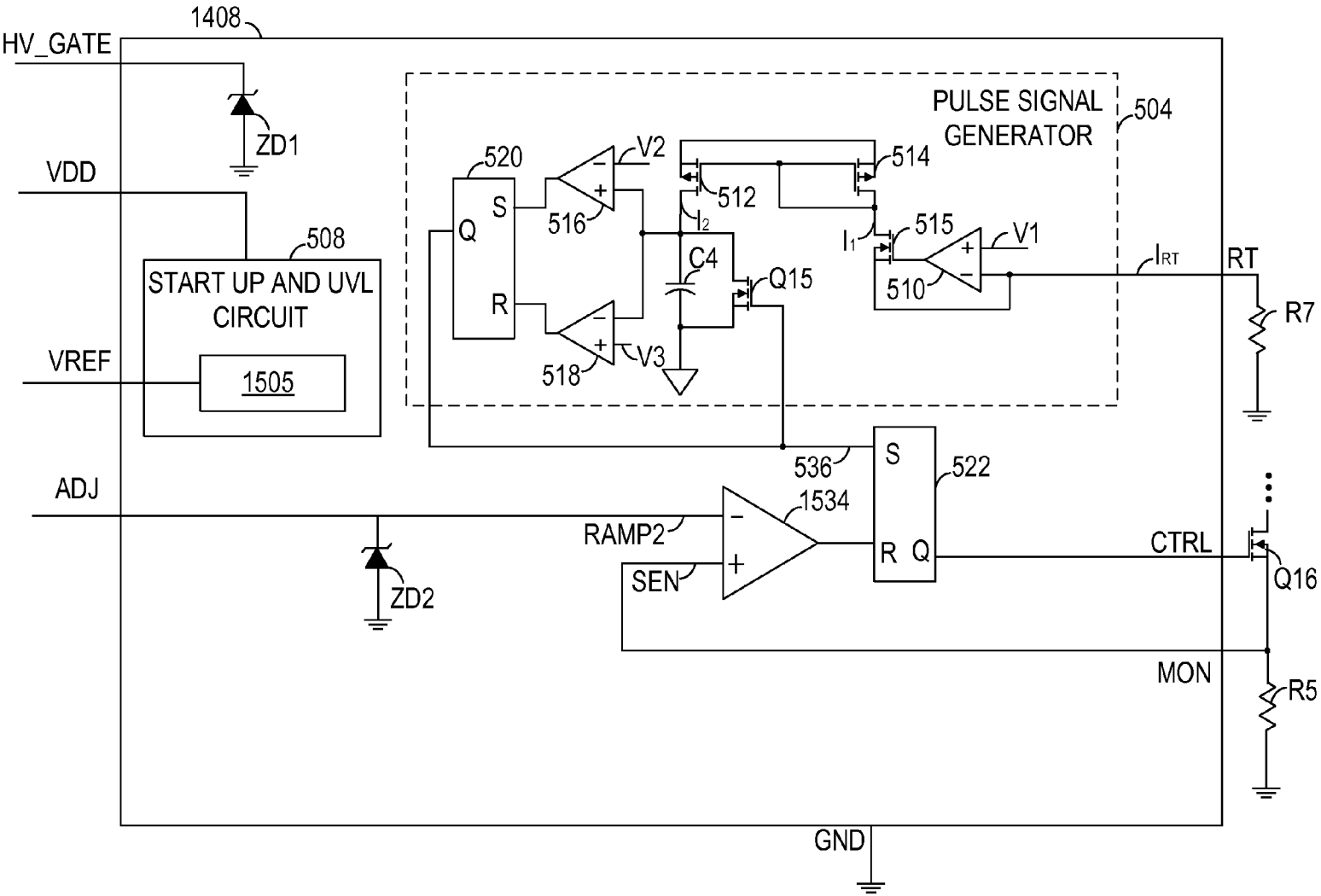
FIG. 15 shows a structure of a dimming controller in FIG. 14, in accordance with one embodiment of the present invention.

FIG. 15 shows a structure of a dimming controller 1408 in FIG. 14, in accordance with one embodiment of the present invention. Elements labeled the same as in FIG. 11 have similar functions. FIG. 15 is described in combination with FIG. 14.

In the example of FIG. 15, the dimming controller 1408 includes a pulse signal generator 504, a start up and under voltage lockout (UVL) circuit 508, and a comparator 1534. The start up and under voltage lockout circuit 508 can selectively turn on one or more components of the dimming controller 1408 according to different power conditions. In the example of FIG. 15, the start up and under voltage lockout circuit 508 further includes a reference voltage generator 1505 for providing a DC voltage at the terminal VREF. The pulse signal generator 504 is operable for generating a pulse signal for turning on the control switch Q16. The comparator 1534 compares the ramp signal RAMP2 received at the terminal ADJ with a current monitoring signal SEN from the current sensing resistor R5. The ramp signal RAMP2 is provided to the inverting input of the comparator 1106. The current monitoring signal SEN is provided to the non-inverting input of the comparator 1106. The voltage of the current monitoring signal SEN indicates a current flowing through the LED string 312 when the switch Q27 and the control switch Q16 are turned on. In the example of FIG. 15, the voltage of the ramp signal RAMP2 determines a peak value Imax of the LED current. A Zener diode ZD2 is coupled between the terminal ADJ and ground for clamping a voltage of the ramp signal RAMP2.

Figure 16:
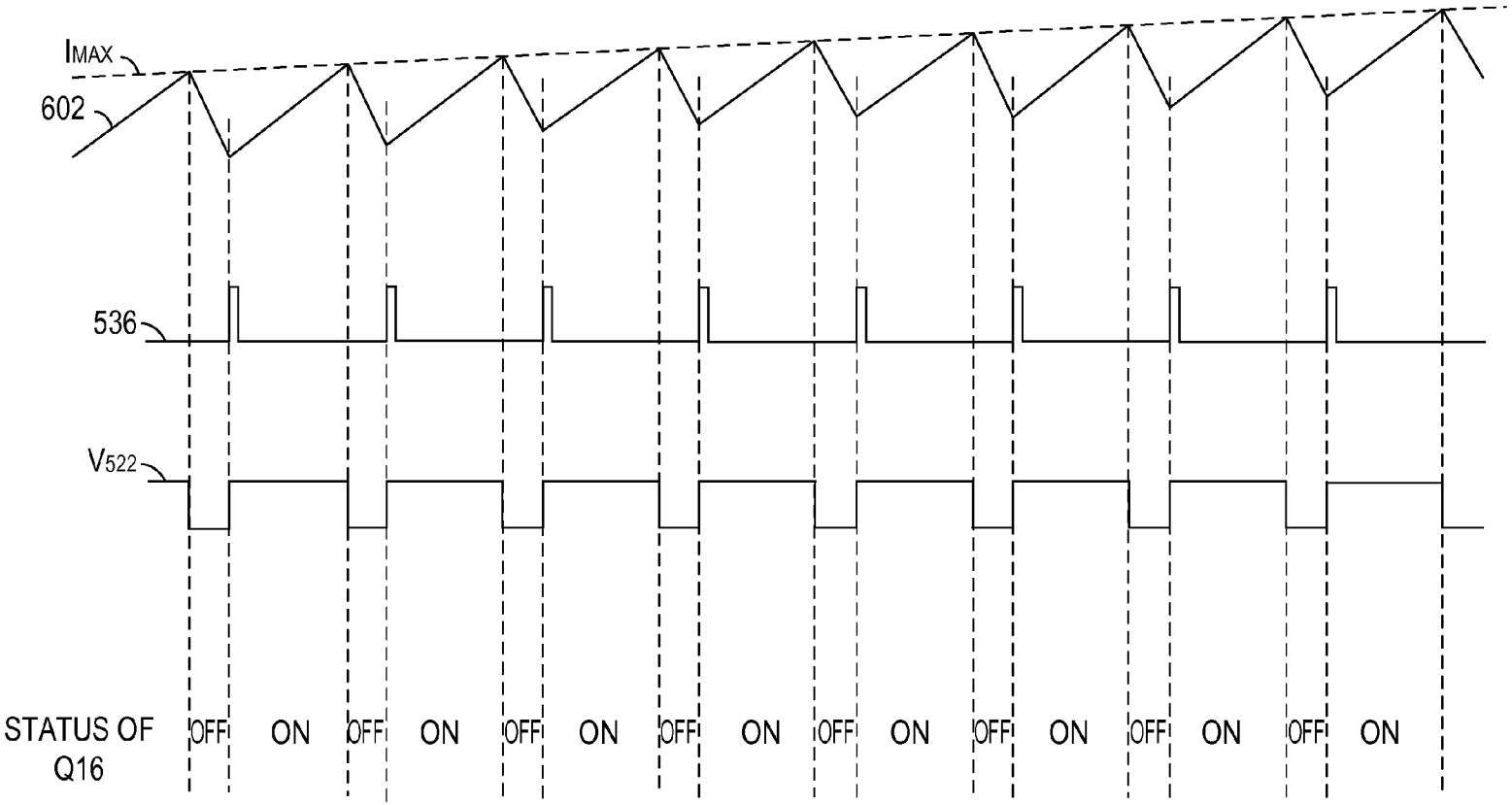
FIG. 16 shows signal waveforms associated with a light source driving circuit which includes the dimming controller in FIG. 15, in accordance with one embodiment of the present invention.

FIG. 16 shows signal waveforms associated with a light source driving circuit which includes the dimming controller 1408 in FIG. 15. FIG. 16 shows signal waveforms of a current 602 flowing through the LED string 312, the pulse signal 536, the output V522 of the SR flip-flop 522, and the ON/OFF status of the control switch Q16. FIG. 16 is described in combination with FIG. 14 and FIG. 15.

In operation, the pulse signal generator 504 generates the pulse signal 536. The SR flip-flop 522 generates a digital 1 at the Q output in response to each pulse of the pulse signal 536, in one embodiment. The control switch Q16 is turned on when the Q output of the SR flip-flop 522 is digital 1. When the control switch Q16 is turned on, the current through the inductor L1 ramps up and the LED current 602 increases. When the LED current 602 reaches the peak value Imax, which indicates that the voltage of the current monitoring signal SEN is substantially equal to the voltage of the ramp signal RAMP2, the comparator 1534 generates a digital 1 at the R input of the SR flip-flop 522 so that the SR flip-flop 522 generates a digital 0 at the Q output. The control switch Q16 is turned off when the Q output of the SR flip-flop 522 is digital 0. When the control switch Q16 is turned off, the inductor L1 is discharged to power the LED string 312 and the LED current 602 decreases. By adjusting the voltage of the ramp signal RAMP2, the average current flowing through the LED string 312 can be adjusted accordingly, and therefore the light output of the LED string 312 is adjusted.

When the power switch 304 is turned on, the dimming controller 1408 is supplied with power through the terminal VDD. If the voltage at the terminal VDD is greater than a predetermined voltage, the dimming controller 1408 provides a DC voltage at the terminal VREF. The capacitor C14 is charged by the DC voltage such that the voltage across the capacitor C14, i.e., the ramp signal RAMP2, increases. Therefore, if the power switch 304 is turned on, the peak value Imax of the LED current gradually increases until reaching a predetermined maximum level. As a result, an average current flowing through the LED string 312 gradually increases.

Figure 17:
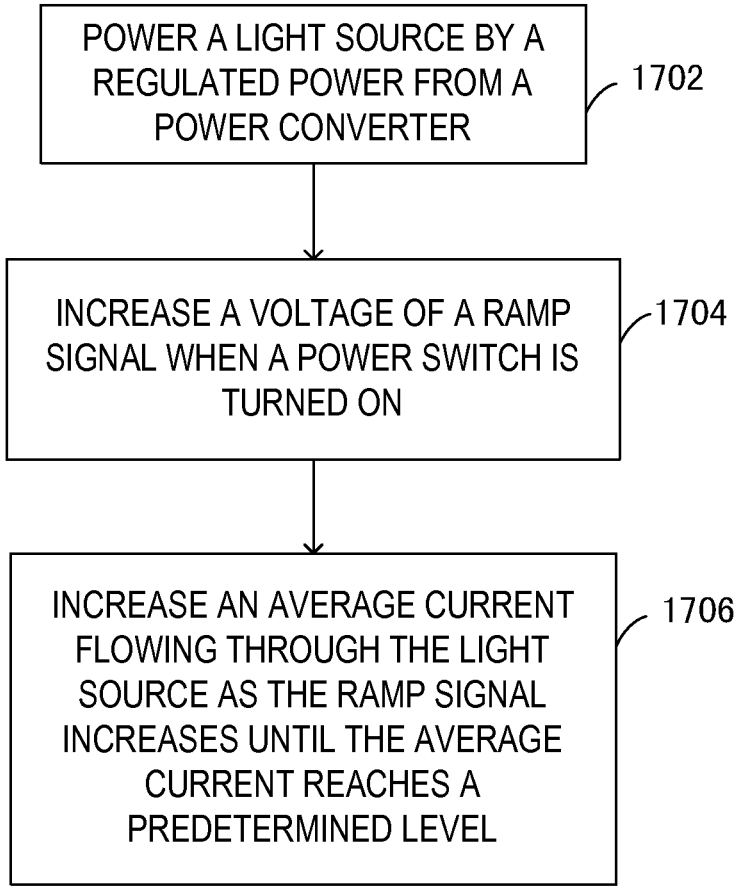
FIG. 17 shows a flowchart of a method for adjusting power of a light source, in accordance with one embodiment of the present invention.

FIG. 17 shows a flowchart of a method for adjusting power of a light source, in accordance with one embodiment of the present invention. FIG. 17 is described in combination with FIG. 10 and FIG. 14. In block 1702, a light source, e.g., the LED string 312, is powered by a regulated power from a power converter, e.g., the power converter 310. In block 1704, if a power switch, e.g., the power switch 304, coupled between a power source and the power converter 310 is turned on, a voltage of a ramp signal is increased.

In block 1706, an average current flowing through the light source increases as the ramp signal increases until the average current reaches a predetermined level. In one embodiment, a pulse-width modulation signal having a first state and a second state is generated by comparing the ramp signal with a sawtooth signal. A duty cycle of the pulse-width modulation signal is determined by the voltage of the ramp signal. A control switch coupled in series with the light source, e.g., the control switch Q16, is controlled based on the pulse-width modulation signal to adjust the average current flowing through the light source. Furthermore, a pulse signal is generated. If the pulse-width modulation signal is in the first state, the control switch is turned on in response to the pulse signal and is turned off if a current monitoring signal indicating the current flowing through the light source increases to a reference signal which determines a peak value of the current through the light source. If the pulse-width modulation signal is in the second state, the control switch is turned off.

In another embodiment, the ramp signal can determine a peak value of a current flowing through the light source. The ramp signal is compared with a current monitoring signal indicating a current flowing through the light source to generate a control signal. The control switch is controlled by the control signal. Furthermore, a pulse signal is generated. The control switch is turned on in response to the pulse signal and is turned off if the current monitoring signal increases to the ramp signal.

Accordingly, embodiments in accordance with the present invention provide light source driving circuits that can gradually increase the brightness of a light source if a power switch coupled between a power source and the light source driving circuit is turned on. Therefore, a sudden brightness change of the light source can be avoided, and a more comfortable user experience is provided.

Figure 18:
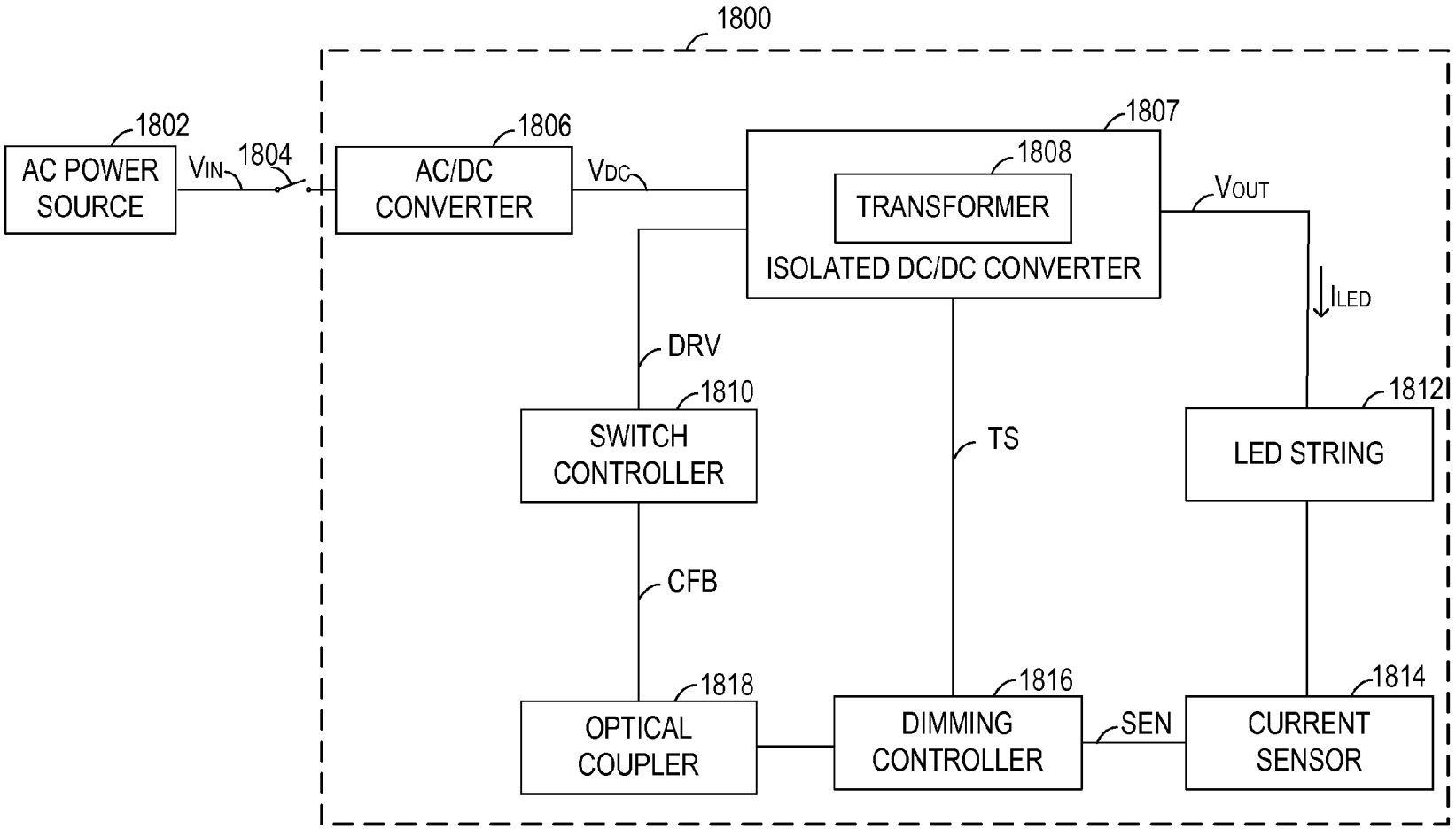
FIG. 18 shows a block diagram of an LED light source driving circuit, in accordance with one embodiment of the present invention.

FIG. 18 shows a block diagram of a light source driving circuit 1800, in accordance with another embodiment of the present invention. The light source driving circuit 1800 utilizes an isolated DC/DC converter 1807 which includes a transformer 1808. The transformer 1808 includes a primary winding and a secondary winding to achieve isolation between a primary side circuit electrically coupled to the primary winding and a secondary side circuit electrically coupled to the secondary winding so as to suppress high-frequency electromagnetic noise. In one embodiment, a power switch 1804 coupled between an AC power source 1802 and the light source driving circuit 1800 is operable for selectively coupling the power source 1802 to the light source driving circuit 1800. An example of the power switch 1804 is illustrated in FIG. 19 according to one embodiment of the present invention. In one embodiment, the power switch 1804 is an on/off switch mounted on the wall. By switching a handle 1980, the conductance status of the power switch 1804 is controlled on or off, e.g., by a user.

Referring back to FIG. 18, the light source driving circuit 1800 further includes an AC/DC converter 1806, a switch controller 1810, a current sensor 1814, a dimming controller 1816, and an optical coupler 1818. The AC/DC converter 1806 converts an input AC voltage $V_{IN}$ from the AC power source 1802 to a DC voltage $V_{DC}$. The isolated DC/DC converter 1807 coupled between the AC/DC converter 1806 and a light source, e.g., an LED string 1812, is operable for receiving power from the AC power source 1802 and for providing regulated output power $V_{OUT}$ to the LED string 1812. The switch controller 1810 coupled between the optical coupler 1818 and the primary winding of the transformer 1808 is operable for receiving a feedback signal CFB indicative of a target level of a current $I_{LED}$ flowing through the LED string 1812 from the optical coupler 1818 and for controlling the input power to the primary winding according to the feedback signal CFB. More specifically, the switch controller 1810 generates a driving signal DRV according to the feedback signal CFB. The driving signal DRV controls the input power to the primary winding, thereby regulating the output power $V_{OUT}$ of the isolated DC/DC converter 1807. The current sensor 1814 generates a current monitoring signal SEN indicating a level of a current $I_{LED}$ flowing through the LED string 1812. The dimming controller 1816 coupled between the optical coupler 1818 and the secondary winding of the transformer 1808 is operable for receiving a switch monitoring signal TS indicative of an operation (e.g., a turn-off operation) of the power switch 1804 and for regulating the output power $V_{OUT}$ from the isolated DC/DC converter 1807 by adjusting the feedback signal CFB according to the switch monitoring signal TS.

In one embodiment, the dimming controller 1816 operates in an analog dimming mode and adjusts the power of the LED string 1812 by adjusting a voltage of a reference signal indicating a target average value of the current $I_{LED}$ flowing through the LED string 1812. In another embodiment, the dimming controller 1816 operates in a burst dimming mode and adjusts the power of the LED string 1812 by adjusting a duty cycle of a pulse-width modulation (PWM) signal. By adjusting the power of the LED string 1812, the light output of the LED string 1812 is adjusted accordingly.

Figure 20:
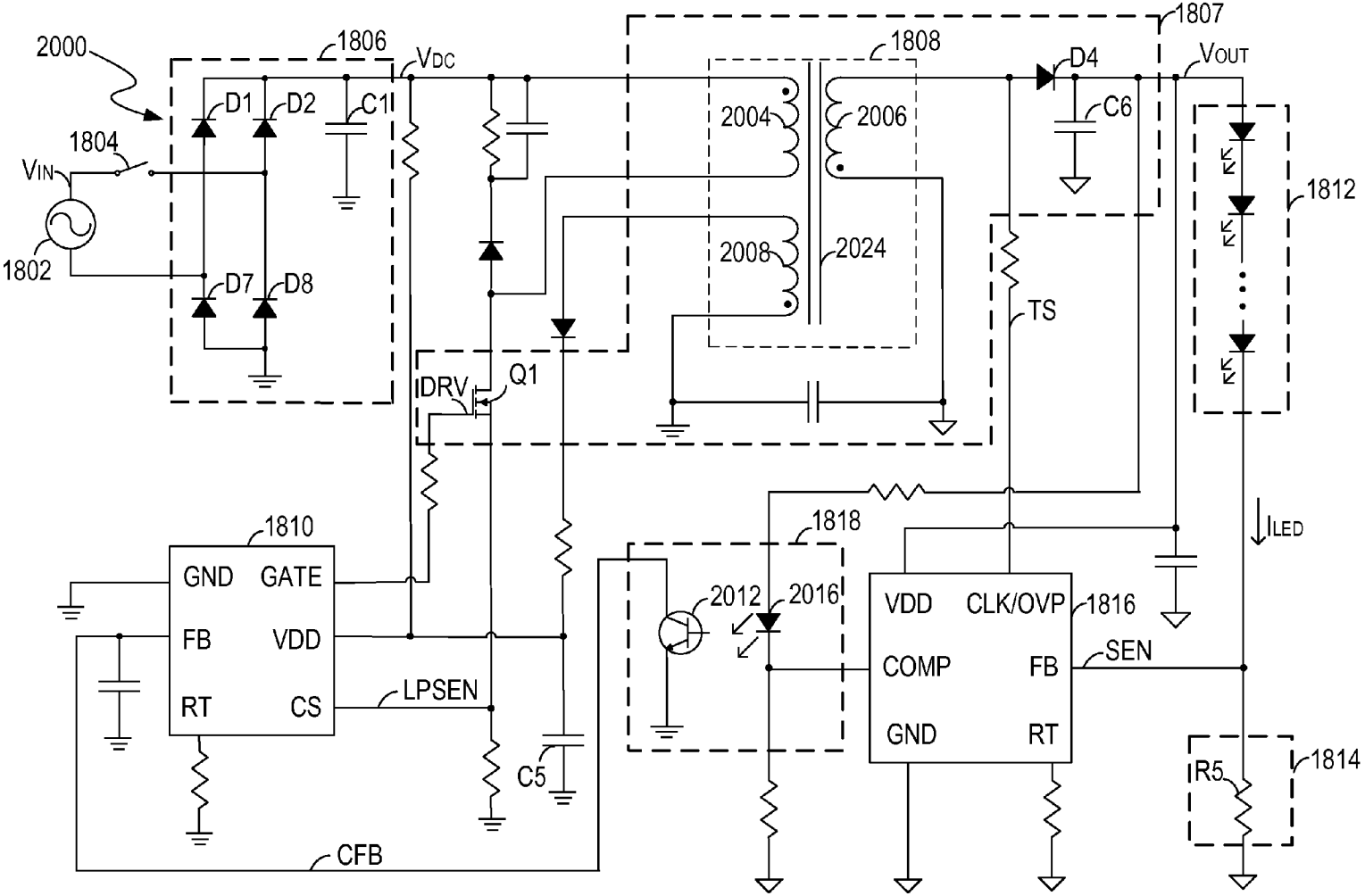
FIG. 20 shows a schematic diagram of an LED light source driving circuit, in accordance with one embodiment of the present invention.

FIG. 20 shows a schematic diagram of a light source driving circuit 2000, in accordance with one embodiment of the present invention. FIG. 20 is described in combination with FIG. 18. Elements labeled the same as in FIG. 18 have similar functions.

In the example of FIG. 20, the AC/DC converter 1806 includes a rectifier, e.g., a bridge rectifier including diodes D1, D2, D7, D8, and includes a capacitor C1. The current sensor 1814 can be a current sensing resistor R5.

The isolated DC/DC converter 1807 receives power from the AC/DC converter 1806 and provides regulated power $V_{OUT}$ to a light source, e.g., the LED string 1812. In the example of FIG. 20, the isolated DC/DC converter 1807 includes a transformer 1808, a control switch Q1, a diode D4, and a capacitor C6. The transformer 1808 includes a primary winding 2004 for receiving input power from the AC/DC converter 1806, a secondary winding 2006 for providing output power to the LED string 1812, and a magnetic core 2024. The transformer 1808 further includes an auxiliary winding 2008 for providing power to the switch controller 1810. For illustrative purposes, three windings are shown in the example of FIG. 20. However, a different number of windings can be included in the transformer 1808. In the embodiment shown in FIG. 20, the control switch Q1 coupled to the primary winding 2004 is located outside the switch controller 1810. Alternatively, the control switch Q1 can be included in the switch controller 1810.

The switch controller 1810 is electrically coupled to the primary winding 2004 and the auxiliary winding 2008 of the transformer 1808. The switch controller 1810 can be a flyback PWM controller, which is operable for generating a pulse-width modulation (PWM) signal to selectively turn on the control switch Q1 coupled in series with the primary winding 2004, and for adjusting the output power of the transformer 1808 by adjusting a duty cycle of the PWM signal. By way of example, and not limitation, terminals of the switch controller 1810 includes FB, GATE, CS, RT, VDD, and GND. The terminal FB receives a feedback signal CFB indicative of a target level of a current $I_{LED}$ flowing through the LED string 1812 from the optical coupler 1818. By way of example, the optical coupler 1818 includes an LED 2016 and a phototransistor 2012. The terminal FB receives the feedback signal CFB from the phototransistor 2012.

The terminal CS receives a sensing signal LPSEN indicating a current flowing through the primary winding 2004. The switch controller 1810 receives the feedback signal CFB and the sensing signal LPSEN, and generates a driving signal DRV at the terminal GATE to control the control switch Q1 so as to regulate the output power $V_{OUT}$ of the isolated DC/DC converter 1807. In one embodiment, the driving signal DRV is a PWM signal. The terminal RT is used to determine a frequency of the driving signal DRV.

The terminal GATE provides the driving signal DRV to control a conductance status, e.g., ON/OFF status, of the control switch Q1 according to the feedback signal CFB. More specifically, in one embodiment, when the voltage of the sensing signal LPSEN is greater than that of the feedback signal CFB, indicating that the target level of the current $I_{LED}$ flowing through the LED string 1812 is less than the current flowing through the primary winding 2004, the switch controller 1810 decreases the duty cycle of the driving signal DRV, and vice versa. In one embodiment, if the driving signal DRV is in a first state (e.g., logic high), the control switch Q1 is turned on, the current flows through the primary winding 2004, and the magnetic core 2024 stores energy. If the driving signal DRV is in a second state (e.g., logic low), the control switch Q1 is turned off, and the diode D4 coupled to the secondary winding 2006 is forward-biased so that the energy stored in the magnetic core 2024 is released to the capacitor C6 and the LED string 1812 through the secondary winding 2006. Accordingly, the power of the LED string 1812 and the light output of the LED string 1812 are adjusted.

The terminal VDD is coupled to the AC/DC converter 1806 and the auxiliary winding 2008. In one embodiment, an energy storage unit, e.g., a capacitor C5, coupled between the terminal VDD and ground can power the switch controller 1810 when the power switch 1804 is turned off. The terminal GND is coupled to ground.

The dimming controller 1816 is electrically coupled to the secondary winding 2006 of the transformer 1808 and operable for receiving a switch monitoring signal TS indicative of an operation of a power switch, e.g., the power switch 1804 coupled between the AC power source 1802 and the AC/DC converter 1806, and for regulating the output power $V_{OUT}$ of the isolated DC/DC converter 1807 by adjusting the feedback signal CFB according to the switch monitoring signal TS. In one embodiment, terminals of the dimming controller 1816 can include CLK/OVP, FB, COMP, RT, VDD, and GND.

The terminal CLK/OVP is coupled to the secondary winding 2006 and operable for receiving the switch monitoring signal TS indicative of an operation of the power switch 1804 coupled between the AC power source 1802 and the AC/DC converter 1806. In one embodiment, after the power switch 1804 is turned on, the switch monitoring signal TS has a positive-negative pulse waveform. More specifically, when the voltage of the secondary winding 2006 of the transformer 1808 is increased to a rising threshold of the transformer 1808, the switch monitoring signal TS changes from a negative voltage level to a positive voltage level. When the voltage of the secondary winding 2006 of the transformer 1808 is decreased to a falling threshold of the transformer 1808, the switch monitoring signal TS changes from the positive voltage level to the negative voltage level. After the power switch 1804 is turned off, the switch monitoring signal TS is zero, in one embodiment. The dimming controller 1816 monitors the voltage of the switch monitoring signal TS so as to monitor the operation of the power switch 1804 and to detect when the power switch 1804 is turned on and when the power switch 1804 is turned off. In one embodiment, the dimming controller 1816 further includes an over-voltage protection (OVP) circuit to prevent an over-voltage condition of the LED string 1812.

The terminal FB is coupled to the current sensing resistor R5 for receiving a current monitoring signal SEN indicating a current $I_{LED}$ flowing through the LED string 1812. The terminal COMP is operable for generating a compensation signal to control the control switch Q1 in series with the primary winding 2004 of the transformer 1808 to adjust power to the LED string 1812 based on the operation of the power switch 1804 and the switch monitoring signal TS. More specifically, the compensation signal at the terminal COMP is used to adjust the feedback signal CFB received by the switching controller 1810.

The terminal RT is used to set a predetermined time period. In one embodiment, upon expiration of the predetermined time period, a counter in the dimming controller 1816 is reset. The terminal VDD is used to provide power to the dimming controller 1816. In one embodiment, an energy storage unit, e.g., a capacitor C6, coupled between the terminal VDD and ground can power the dimming controller 1816 when the power switch 1804 is turned off. The terminal GND is coupled to ground.

Advantageously, in response to a turn-off operation of the power switch 1804 in the primary side circuit, the light output of the LED string 1812 can be adjusted to a target level by the dimming controller 1816 in the secondary side circuit with feedback loop control after the power switch 1804 is turned on again.

Figure 21:
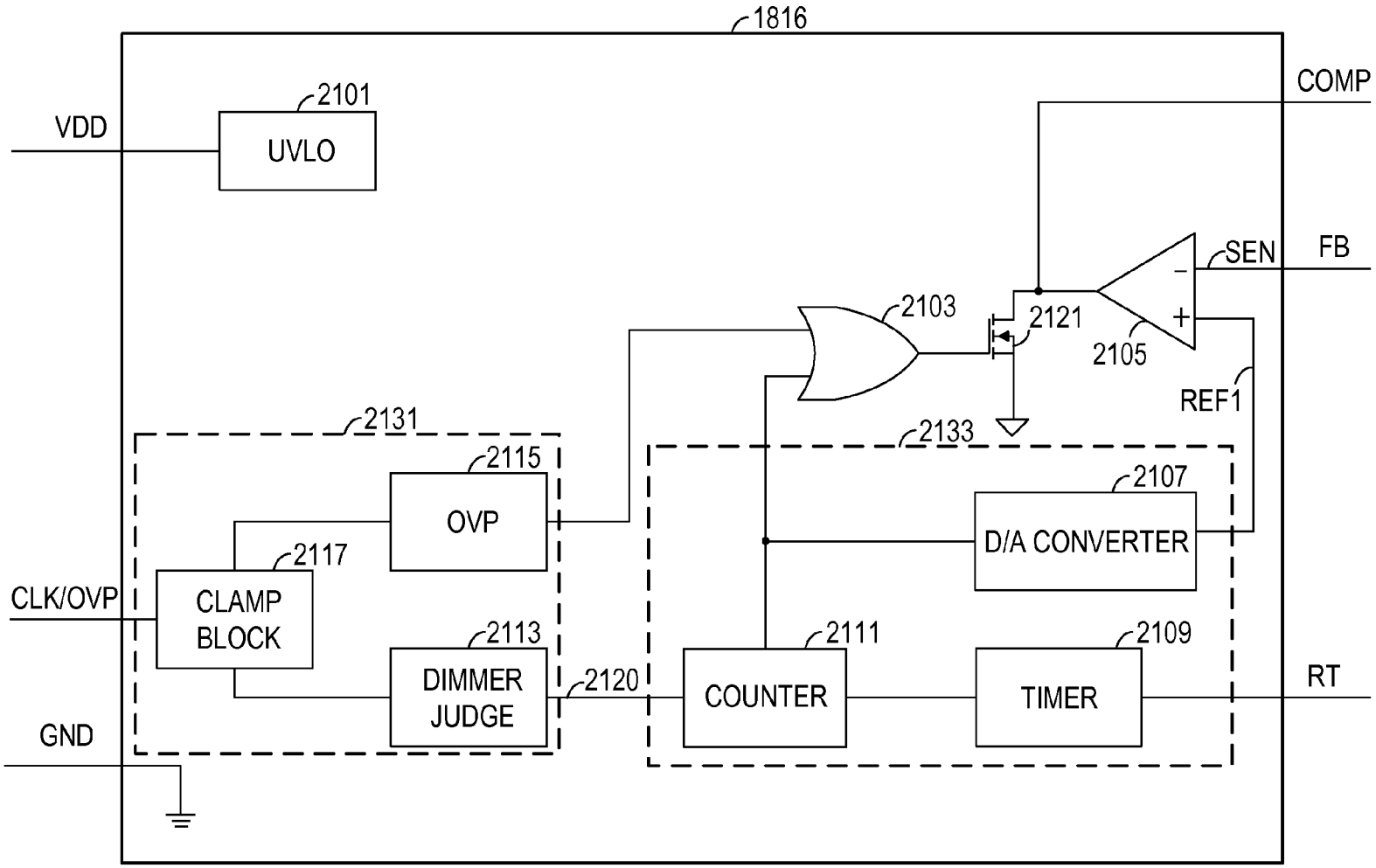
FIG. 21 shows a structure of a dimming controller in FIG. 20, in accordance with one embodiment of the present invention.

FIG. 21 shows an example of a structure of the dimming controller 1816 in FIG. 20, in accordance with one embodiment of the present invention. FIG. 21 is described in combination with FIG. 20. Elements labeled the same as in FIG. 20 have similar functions.

The dimming controller 1816 includes a trigger monitoring unit 2131 and a dimmer 2133. The trigger monitoring unit 2131 is operable for receiving the switch monitoring signal TS from the terminal CLK/OVP and for generating a driving signal 2120 in response to the operation of the external power switch 1804 detected at the terminal CLK/OVP. In one embodiment, the trigger monitoring unit 2131 includes a clamp block 2117 and a dimmer judge 2113. The clamp block 2117 is operable for clamping a voltage of the switch monitoring signal TS. The dimmer judge 2113 is operable for generating the driving signal 2120 according to the switch monitoring signal TS. In one embodiment, the trigger monitoring unit 2131 generates the driving signal 2120 if a turn-off operation is detected at the terminal CLK/OVP. The trigger monitoring unit 2131 can further include an over-voltage protection (OVP) circuit 2115 to prevent an over-voltage condition of the LED string 1812.

The dimmer 2133 is coupled to the trigger monitoring unit 2131 and operable for generating a dimming signal (for example, a reference signal REF1) to adjust the compensation signal and the feedback signal CFB based on the driving signal 2120. In one embodiment, the dimmer 2133 includes a counter 2111 driven by the driving signal 2120 and operable for counting operations of the power switch 1804. The dimmer 2133 can also include a digital-to-analog converter (D/A converter) 2107 coupled to the counter 2111 and operable for generating the dimming signal based on the counter value of the counter 2111. More specifically, after the power switch 1804 is turned off, the switch monitoring signal TS is zero. Upon detection of the zero voltage at the terminal CLK/OVP, the trigger monitoring unit 2131 generates the driving signal 2120, in one embodiment. The counter value of the counter 2111 is changed, e.g., increased by 1, in response to the driving signal 2120. The D/A converter 2107 reads the counter value from the counter 2111 and generates the dimming signal (e.g., the reference signal REF1) based on the counter value. The dimming signal is used to adjust the output power of the isolated DC/DC converter 1807, which in turn adjusts the light output of the LED string 1812.

As described above, the dimming signal can be an analog reference signal REF1 having an adjustable voltage. The D/A converter 2107 can adjust the voltage of the reference signal REF1 according to the counter value of the counter 2111. In the example of FIG. 21, the voltage of the reference signal REF1 determines an average value of the current $I_{LED}$ flowing through the LED string 1812. As such, the light output of the LED string 1812 is adjusted by adjusting the reference signal REF1.

In one embodiment, the D/A converter 2107 can decrease the voltage of REF1 in response to an increase of the counter value. For example, if the counter value is 0, the D/A converter 2107 adjusts the reference signal REF1 to have a voltage V6. If the counter value is increased to 1 when a turn-off operation of the power switch 1804 is detected at the terminal CLK/OVP by the trigger monitoring unit 2131, the D/A converter 2107 adjusts the reference signal REF1 to have a voltage V7 that is less than V6. Alternatively, the D/A converter 2107 can increase the voltage of the reference signal REF1 in response to an increase of the counter value.

In one embodiment, the counter value is reset to a predetermined value, e.g., zero, after the counter 2111 reaches its maximum counter value. For example, if the counter 2111 is a 2-bit counter, the counter value will increase from 0 to 1, 2, 3 and then return to zero after four turn-off operations of the switch 1804. Accordingly, the light output (brightness) of the LED string 1812 can be adjusted from a first level to a second level, then to a third level, then to a fourth level, and then back to the first level. The dimmer 2133 can further include a timer 2109 coupled to the counter 2111. When the trigger monitoring unit 2131 detects a turn-off operation of the power switch 1804 via the terminal CLK/OVP, the timer 2109 starts to run. The counter value is reset to the predetermined value, e.g., zero, if the power switch 1804 remains off over a predetermined time period (for example, 3 seconds). The predetermined time period is determined by a voltage at the terminal RT of the dimming controller 1816. Advantageously, if there are multiple LED light source driving circuits controlled by a common wall switch, the control of each LED light sources can be synchronized by using the timer 2109.

The dimming controller 1816 operates in an analog dimming mode in which an operational amplifier 2105 compares the dimming signal (the reference signal REF1) with a current monitoring signal SEN indicating a current $I_{LED}$ flowing through the LED string 1812 and generates a compensation signal to adjust the feedback signal CFB. When the voltage of SEN is greater than that of the reference signal REF1, indicating that the current $I_{LED}$ flowing through the LED string 1812 is greater than a target level that is determined by the reference signal REF1, the operational amplifier 2105 adjusts the compensation signal to decrease the voltage at the terminal COMP. Accordingly, the current through the optical coupler 1818 is increased and the voltage of the feedback signal CFB at the terminal FB of the switch controller 1810 is decreased. As a result, the switch controller 1810 decreases the duty cycle of the driving signal DRV according to the feedback signal CFB so that the output power of the isolated DC/DC converter 1807 is decreased accordingly. Similarly, when the voltage of the reference signal REF1 is greater than that of SEN, indicating that the LED current $I_{LED}$ flowing through the LED string 1812 is less than the target level that is determined by the reference signal REF1, the operational amplifier 2105 adjusts the compensation signal to increase the voltage at the terminal COMP. Accordingly, the voltage of the feedback signal CFB at the terminal FB of the switch controller 1810 is increased. As a result, the switch controller 1810 increases the duty cycle of the driving signal DRV according to the feedback signal CFB so that the output power of the isolated DC/DC converter 1807 is increased accordingly.

The dimming controller 1816 can further include an OR gate 2103. The OR gate 2103 receives an over-voltage signal generated by the OVP circuit 2115 and receives a shutoff signal indicative of a shutoff of the LED string 1812 generated by the counter 2111. More specifically, the OVP circuit 2115 generates the over-voltage signal when the voltage of the switch monitoring signal TS is greater than a predetermined safety voltage. In one embodiment, when the dimming controller 1816 detects that the power switch 1804 remains off for a predetermined time period (for example, 3 seconds) based on the switch monitoring signal TS, the counter 2111 generates the shutoff signal. In addition, the counter value of the counter 2111 is reset to a predetermined value, e.g., zero. The shutoff signal can also be generated by the dimmer judge 2113 or other units, and is not limited to the configuration shown in the example of FIG. 21. The OR gate 2103 outputs a control signal to turn on a switch 2121 according to the over-voltage signal or the shutoff signal. More specifically, the dimming controller 1816 pulls the voltage at the terminal COMP to zero (by turning on the switch 2121) in response to the over-voltage signal (e.g., logic 1) indicating an over-voltage condition of the LED string 1812 or the shutoff signal (e.g., logic 1) indicating that the LED string 1812 is shut off. As a result, the current through the optical coupler 1818 is increased to a maximum value, and the voltage of the feedback signal CFB is decreased to a minimum value. Thus, the switch controller 1810 stops generating the driving signal DRV. When the LED string 1812 restarts and resumes lighting, the over-voltage signal and the shutoff signal are both logic 0, in one embodiment. The switch 2121 is turned off so that the operational amplifier 2105 adjusts the voltage at the terminal COMP according to the reference signal REF1 and the current monitoring signal SEN.

The dimming controller 1816 can further include an Under Voltage Lockout (UVLO) circuit 2101 coupled to the terminal VDD for selectively turning on one or more components of the dimming controller 1816 according to different power conditions. In one embodiment, the UVLO circuit 2101 is operable for turning on all the components of the dimming controller 1816 when the voltage at the terminal VDD is greater than a first predetermined voltage. When the power switch 1804 is turned off, the UVLO circuit 2101 is operable for turning off other components of the dimming controller 1816 except the trigger monitoring unit 2131 and the dimmer 2133 when the voltage at the terminal VDD is less than a second predetermined voltage, in order to save energy. The UVLO circuit 2101 is operable for turning off all the components of the dimming controller 1816 when the voltage at the terminal VDD is less than a third predetermined voltage. In one embodiment, the first predetermined voltage is greater than the second predetermined voltage, and the second predetermined voltage is greater than the third predetermined voltage. Because the dimming controller 1816 can be powered by the capacitor C6 through the terminal VDD, the trigger monitoring unit 2131 and the dimmer 2133 can still operate for a time period after the power switch 1804 is turned off.

Figure 22:
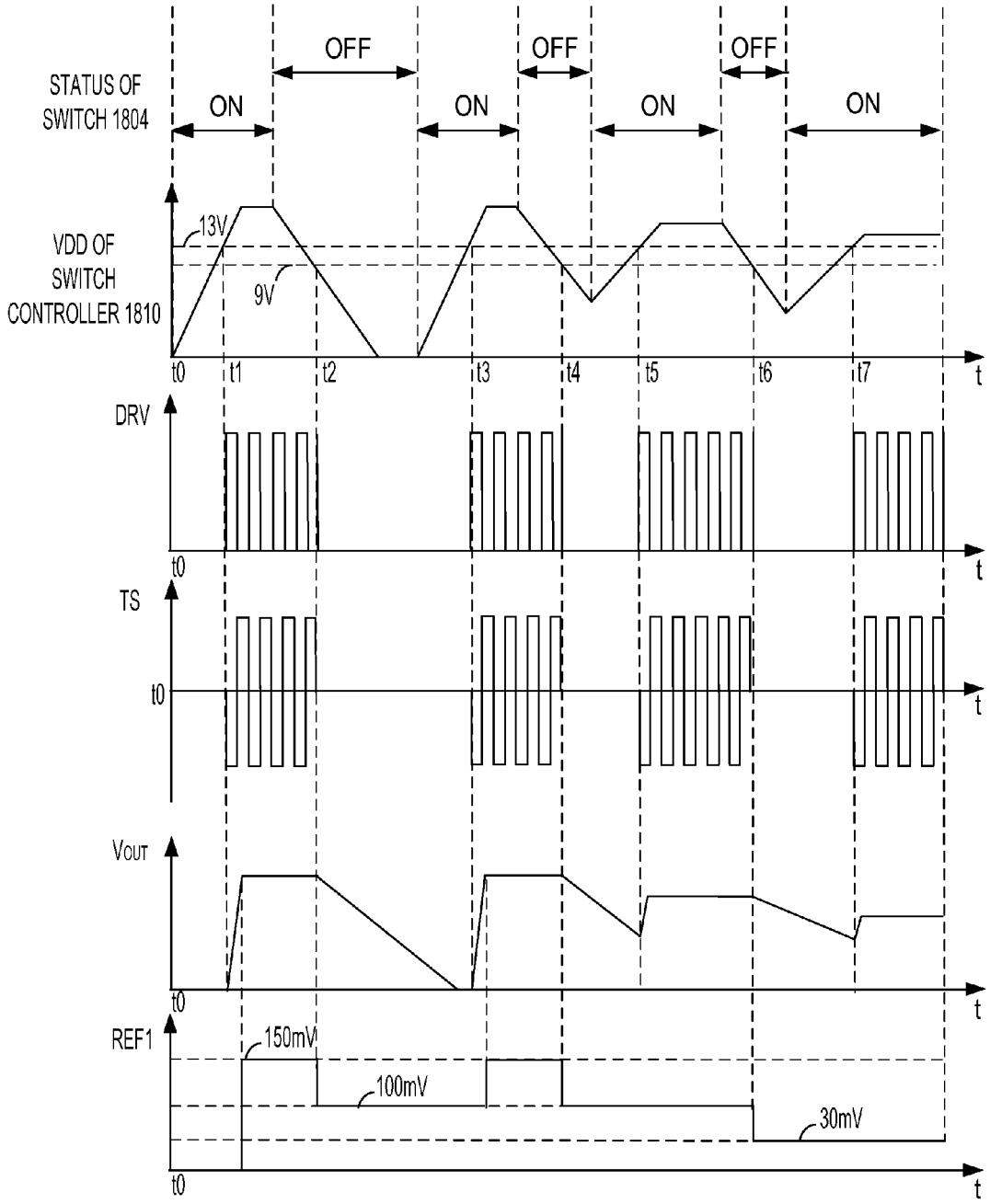
FIG. 22 illustrates signal waveforms in the analog dimming mode, in accordance with one embodiment of the present invention.

FIG. 22 illustrates examples of signal waveforms of the ON/OFF status of the power switch 1804, the voltage at the terminal VDD of the switch controller 1810, the driving signal DRV, the switch monitoring signal TS, the output voltage $V_{OUT}$, and the reference signal REF1 in the analog dimming mode, in accordance with one embodiment of the present invention. FIG. 22 is described in combination with FIG. 20 and FIG. 21.

In operation, at time t0, the power switch 1804 is turned on. At time t1, the voltage at the terminal VDD of the switch controller 1810 is increased to an enable threshold $V_{STH1}$ (for example, 13V) and the switch controller 1810 generates the driving signal DRV. Once the power switch 1804 is turned off, the voltage at the terminal VDD of the switch controller 1810 starts to decrease. At time t2, the voltage at the terminal VDD is decreased to a disable threshold $V_{STH2}$ (for example, 9V) and the switch controller 1810 stops generating the driving signal DRV. Although not shown in FIG. 22, the duty cycle of the driving signal DRV can be adjusted according to the feedback signal CFB of the switch controller 1810.

Furthermore, at times t1, t3, t5, and t7, the voltage at the terminal VDD of the switch controller 1810 is increased to the enable threshold $V_{STH1}$, and the switch monitoring signal TS changes from zero to a positive-negative pulse waveform. At times t2, t4, and t6, the voltage at the terminal VDD of the switch controller 1810 is decreased to the disable threshold $V_{STH2}$, and the switch monitoring signal TS changes from the positive-negative pulse waveform to zero. By monitoring the switch monitoring signal TS, the dimming controller 1816 can detect a turn-off operation of the power switch 1804 and adjust the reference signal REF1.

In the example of FIG. 22, the reference signal REF1 has three voltages: 150 mV, 100 mV, and 30 mV. At time t1, the switch monitoring signal TS detects that the power switch 1804 is turned on. The reference signal REF1 has a first level (e.g., 150 mV). At time t2, the switch monitoring signal TS detects that the power switch 1804 is turned off and the reference signal REF1 is adjusted from the first level to a second level (e.g., 100 mV). In the example of FIG. 22, the time interval between t2 and t3 is greater than a predetermined time period (e.g., t3−t2>3 seconds), indicating that the power switch 1804 is turned on after it remains off over a predetermined time period. Thus, the reference signal REF1 is reset to a predetermined level (e.g., 150 mV) during t3-t4. At time t4, the switch monitoring signal TS detects that the power switch 1804 is turned off and the reference signal REF1 is adjusted from the first level to the second level. The time interval between t4 and t5 is less than the predetermined time period (e.g., t5−t4<3 seconds), indicating that the power switch 1804 is off less than the predetermined time period. Thus, the reference signal REF1 maintains the second level during t5-t6. At time t6, the switch monitoring signal TS detects that the power switch 1804 is turned off and the reference signal REF1 is adjusted from the second level to a third level (e.g., 30 mV). Accordingly, the light output of the LED string 1812 is adjusted in accordance with the reference signal REF1.

Figure 23:
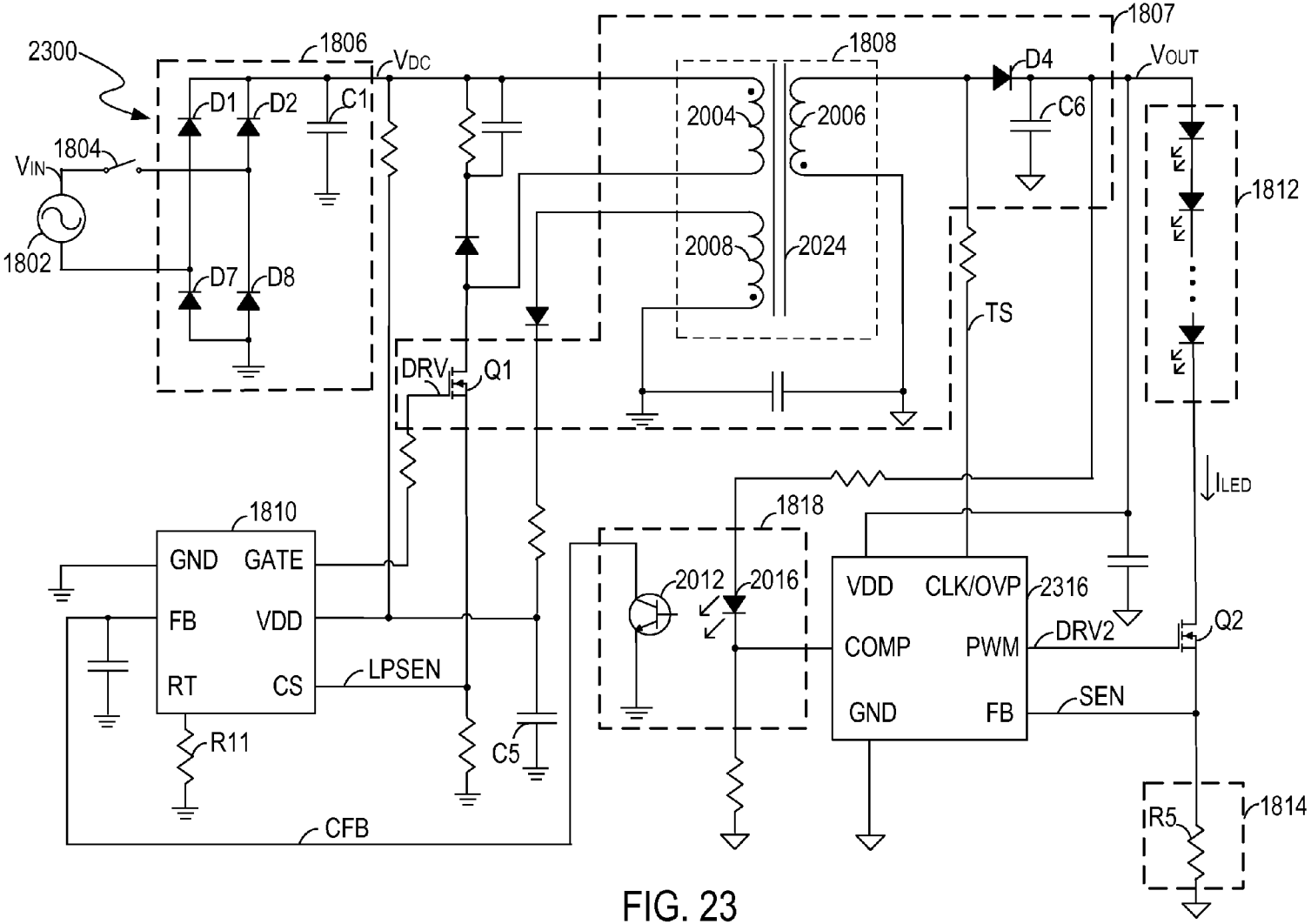
FIG. 23 shows a schematic diagram of an LED light source driving circuit, in accordance with one embodiment of the present invention.

FIG. 23 shows an example of a schematic diagram of a light source driving circuit 2300, in accordance with one embodiment of the present invention. FIG. 23 is described in combination with FIG. 20. Elements labeled the same as in FIG. 20 have similar functions. The schematic diagram of the light source driving circuit 2300 in FIG. 23 is similar to the schematic diagram of the light source driving circuit 2000 in FIG. 20 except for the configuration of the dimming controller 2316. In the example of FIG. 23, terminals of the dimming controller 2316 include CLK/OVP, FB, COMP, PWM, VDD, and GND. The terminal CLK/OVP receives a switch monitoring signal TS indicative of an operation of the power switch 1804.

The terminal FB receives a current monitoring signal SEN indicating a current $I_{LED}$ flowing through the LED string 1812. The terminal COMP provides a compensation signal according to the current monitoring signal SEN and the switch monitoring signal TS. The feedback signal CFB indicative of the target level of the current $I_{LED}$ flowing through the LED string 1812 is adjusted according to the compensation signal via the optical coupler 1818. Therefore, the duty cycle of the driving signal DRV, the output power of the isolated DC/DC converter 1807, and the light output of the LED string 1812 are adjusted accordingly.

The terminal PWM is coupled to a control switch Q2. The control switch Q2 is coupled in series with the LED string 1812, and is coupled to ground through the current sensing resistor R5. By controlling a conductance status, e.g., ON and OFF status, of the control switch Q2 using a PWM signal DRV2 via the terminal PWM and adjusting the duty cycle of the PWM signal DRV2, the dimming controller 2316 can adjust the feedback signal CFB and the current $I_{LED}$ flowing through the LED string 1812. For example, if the PWM signal DRV2 has a duty cycle of 100%, the LED string 1812 can have a maximum light output. If the duty cycle of the PWM signal DRV2 is less than 100%, the LED string 1812 can have a light output that is less than the maximum light output. By way of example and not limitation, the adjustable duty cycle of the PWM signal DRV2 can be 100%, 75%, 50%, and 25%, and thus the LED string 1812 can have a 100% brightness level, 75% brightness level, 50% brightness level, and 25% brightness level, respectively.

The terminal VDD is used to provide power to the dimming controller 2316. In one embodiment, an energy unit, e.g., a capacitor C6, coupled between the terminal VDD and ground can power the dimming controller 2316 when the power switch 1804 is turned off. The terminal GND is coupled to ground.

Advantageously, in response to a turn-off operation of the power switch 1804 in the primary side circuit, the light output of the LED string 1812 can be adjusted to a target level by the dimming controller 2316 in the secondary side circuit with feedback loop control after the power switch 1804 is turned on again.

Figure 24:
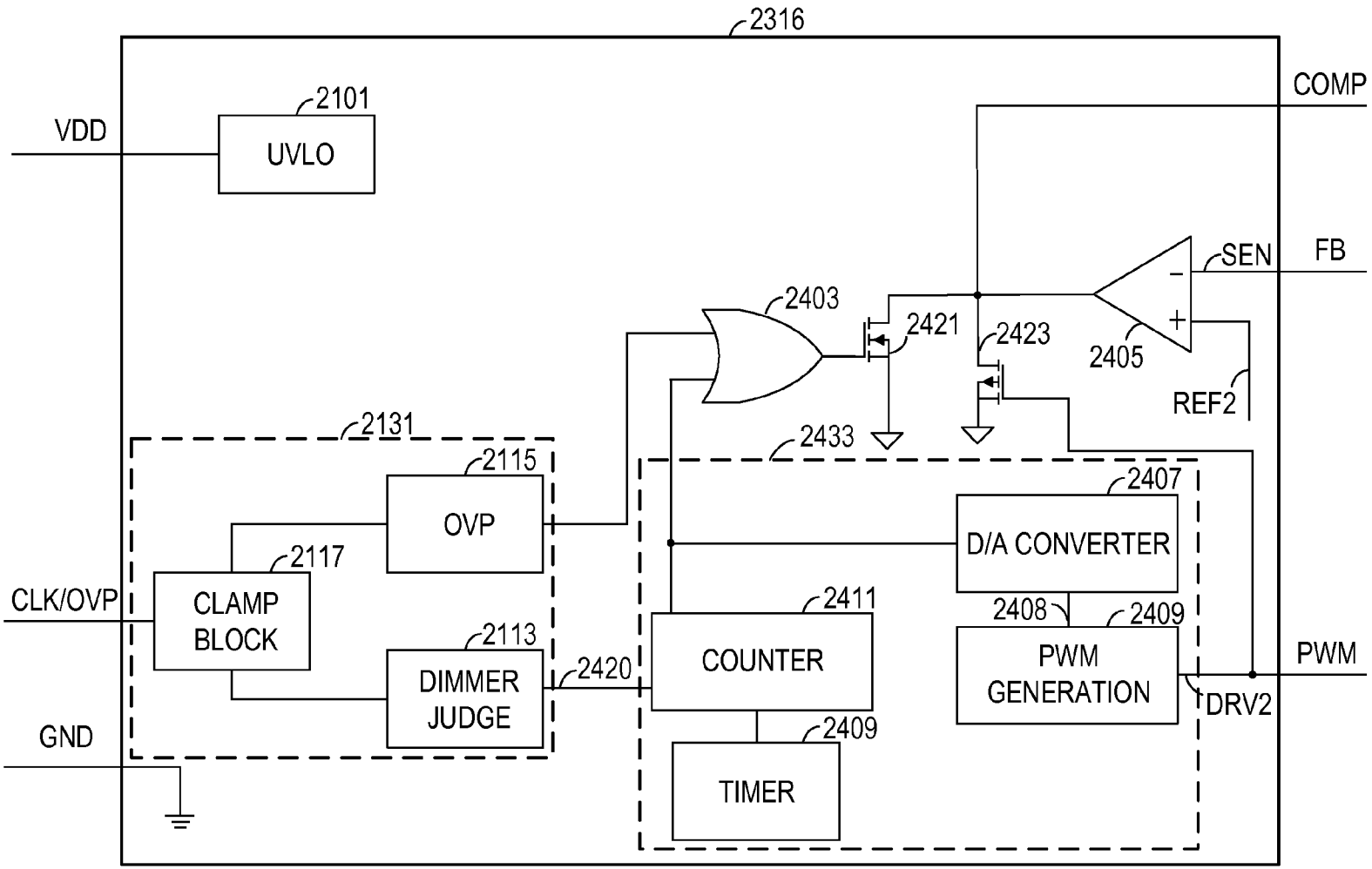
FIG. 24 shows a structure of a dimming controller in FIG. 23, in accordance with one embodiment of the present invention.

FIG. 24 shows an example of a structure of a dimming controller 2316 in FIG. 23, in accordance with one embodiment of the present invention. FIG. 24 is described in combination with FIG. 23. Elements labeled the same as in FIG. 21 and FIG. 23 have similar functions.

The structure of the dimming controller 2316 in FIG. 24 is similar to the structure of the dimming controller 1816 in FIG. 21 except for the configuration of the dimmer 2433 and the operational amplifier 2405. In the example shown in FIG. 24, the dimmer 2433 includes a counter 2411 coupled to the trigger monitoring unit 2131 for counting operations of the power switch 1804, and a digital-to-analog converter (D/A converter) 2407 coupled to the counter 2411. The counter 2411 is driven by a driving signal 2420 generated by the trigger monitoring unit 2131. More specifically, after the power switch 1804 is turned off, the switch monitoring signal TS is zero, in one embodiment. Upon detection of the zero voltage at the terminal CLK/OVP, the trigger monitoring unit 2131 generates the driving signal 2420. The counter value of the counter 2411 is changed, e.g., increased by 1, in response to the driving signal 2420. The D/A converter 2407 reads the counter value from the counter 2411 and generates a dimming signal 2408 based on the counter value. The dimmer 2433 can further include a timer 2409 coupled to the counter 2411, similar to the timer 2109 in FIG. 21.

The dimmer 2433 further includes a PWM generator 2409 coupled to the D/A converter 2407. The dimming controller 2316 operates in a burst dimming mode in which a PWM signal DRV2 is generated based on the dimming signal 2408. The duty cycle of the PWM signal DRV2 (for example, 100%, 75%, 50%, or 25%) is determined by the dimming signal 2408. The PWM signal DRV2 adjusts the compensation signal and the feedback signal CFB and controls the control switch Q2 coupled in series with the LED string 1812. More specifically, an operational amplifier 2405 receives a current monitoring signal SEN and a reference signal REF2, and generates a compensation signal at the terminal COMP. In the example of FIG. 24, the reference signal REF2 is a DC signal having a substantially constant voltage. When the PWM signal DRV2 is in a first state, e.g., logic 1, the control switch Q2 is on and the switch 2423 is off. Thus, the operational amplifier 2405 generates the compensation signal according to the current monitoring signal SEN and the reference signal REF2. The feedback signal CFB indicative of the target level of the current $I_{LED}$ flowing through the LED string 1812 is adjusted by the compensation signal via the optical coupler 1818. When the PWM signal DRV2 is in a second state, e.g., logic 0, the control switch Q2 is off and the switch 2423 is on. Thus, the compensation signal is pulled to zero. The voltage of the feedback signal CFB is decreased to a minimum value, and the switch controller 1810 stops generating the driving signal DRV. Therefore, the dimming signal 2408 can be used to adjust the feedback signal CFB, which can in turn adjust the light output of the LED string 1812.

The dimming controller 2316 can further include an OR gate 2403 operable for receiving an over-voltage signal generated by the OVP circuit 2115 and receiving a shutoff signal indicative of a shutoff of the LED string 1812 generated by the counter 2411. More specifically, the OVP circuit 2115 generates the over-voltage signal when the voltage of the switch monitoring signal TS is greater than a predetermined safety voltage. When the dimming controller 2316 detects that the power switch 1804 remains off for a predetermined time period (for example, 3 seconds) based on the switch monitoring signal TS, the counter 2411 generates the shutoff signal. In addition, the counter value of the counter 2411 is reset to a predetermined value, e.g., zero. The OR gate 2403 and the switch 2421 functions in a similar way as the OR gate 2103 and the switch 2121 in FIG. 21.

Advantageously, in response to a turn-off operation of the power switch 1804 in the primary side circuit, the light output of the LED string 1812 can be adjusted to a target level by the dimming controller 2316 in the secondary side circuit with feedback loop control after the power switch 1804 is turned on again.

Figure 25:
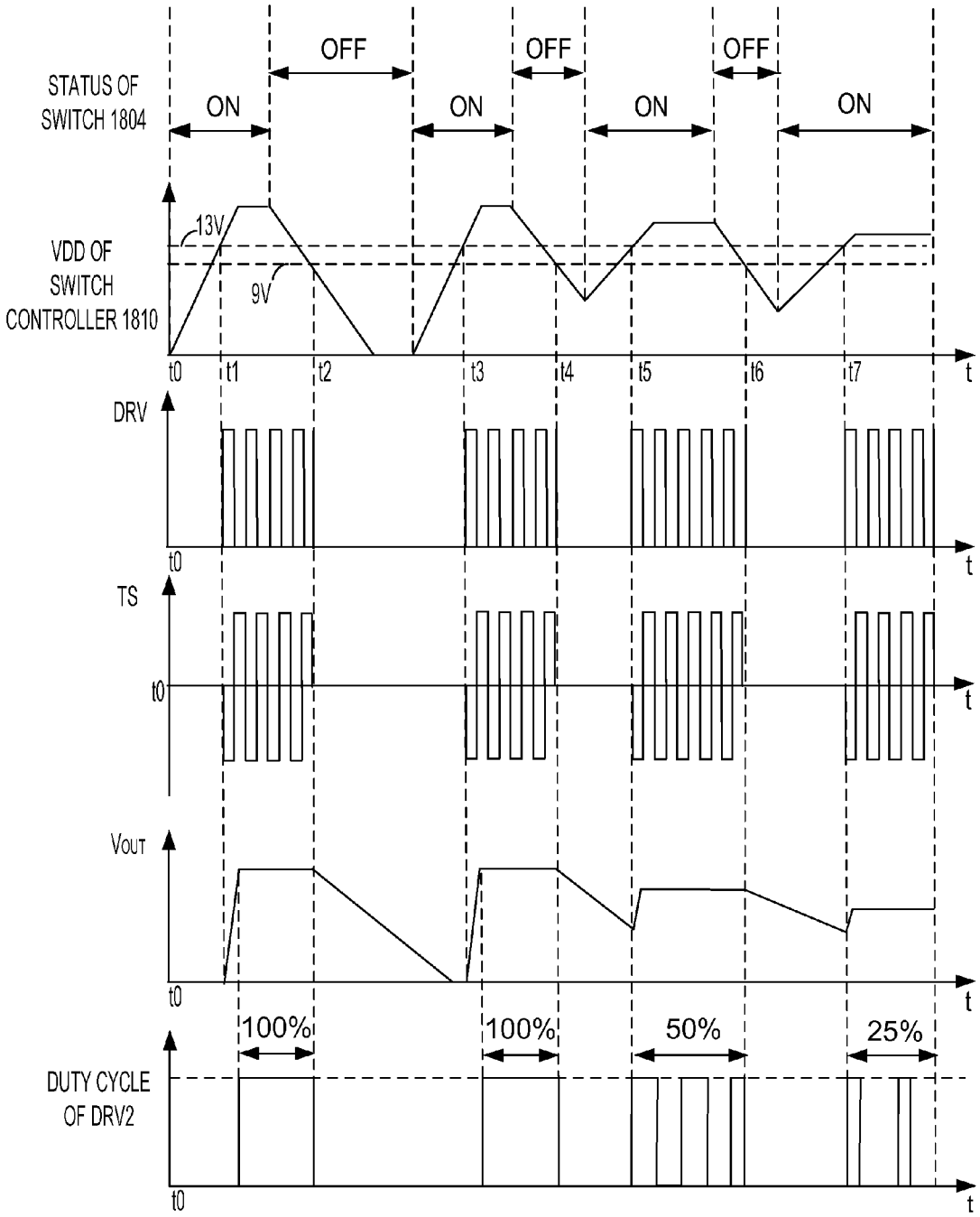
FIG. 25 illustrates signal waveforms in the burst dimming mode, in accordance with one embodiment of the present invention.

FIG. 25 illustrates examples of signal waveforms of the ON/OFF status of the power switch 1804, the voltage at the terminal VDD of the switch controller 1810, the driving signal DRV, the switch monitoring signal TS, the output voltage $V_{OUT}$, and the duty cycle of the PWM signal DRV2 in the burst dimming mode, in accordance with one embodiment of the present invention. FIG. 25 is described in combination with FIG. 23 and FIG. 24.

The relation among the ON/OFF status of the power switch 1804, the voltage at the terminal VDD of the switch controller 1810, the driving signal DRV, the switch monitoring signal TS, and the output voltage $V_{OUT}$ is similar to what is illustrated in FIG. 22. In the analog dimming mode shown in FIG. 22, by adjusting the reference signal REF1, the output voltage $V_{OUT}$ can be adjusted accordingly and therefore the light output of LED string 1812 can be adjusted. In the burst dimming mode shown in FIG. 25, at time t0, the power switch 1804 is turned on. At t1, the switch monitoring signal TS detects that the switch 1804 is on and the PWM signal DRV2 has a first duty cycle (e.g., 100%). At t2, the switch monitoring signal TS detects that the switch 1804 is off. In the example of FIG. 25, the time interval between t2 and t3 is greater than a predetermined time period (e.g., t3−t2>3 seconds), indicating that the power switch 1804 is turned on after it remains off over a predetermined time period. Thus, the duty cycle of the PWM signal DRV2 is reset to a predetermined level (e.g., 100%) during t3−t4. At t4, the switch monitoring signal TS detects that the switch 1804 is off. The time interval between t4 and t5 is less than the predetermined time period (e.g., t5−t4<3 seconds), indicating that the power switch 1804 is off less than the predetermined time period. Thus, the duty cycle of the PWM signal DRV2 is adjusted to a second level (e.g., 50%) during t5−t6. Similarly, the duty cycle of the PWM signal DRV2 is adjusted to a third level (e.g., 25%) at t7. By adjusting the duty cycle of the PWM signal DRV2, the output voltage $V_{OUT}$ can be adjusted accordingly and therefore the light output of LED string 1812 can be adjusted.

Figure 26:
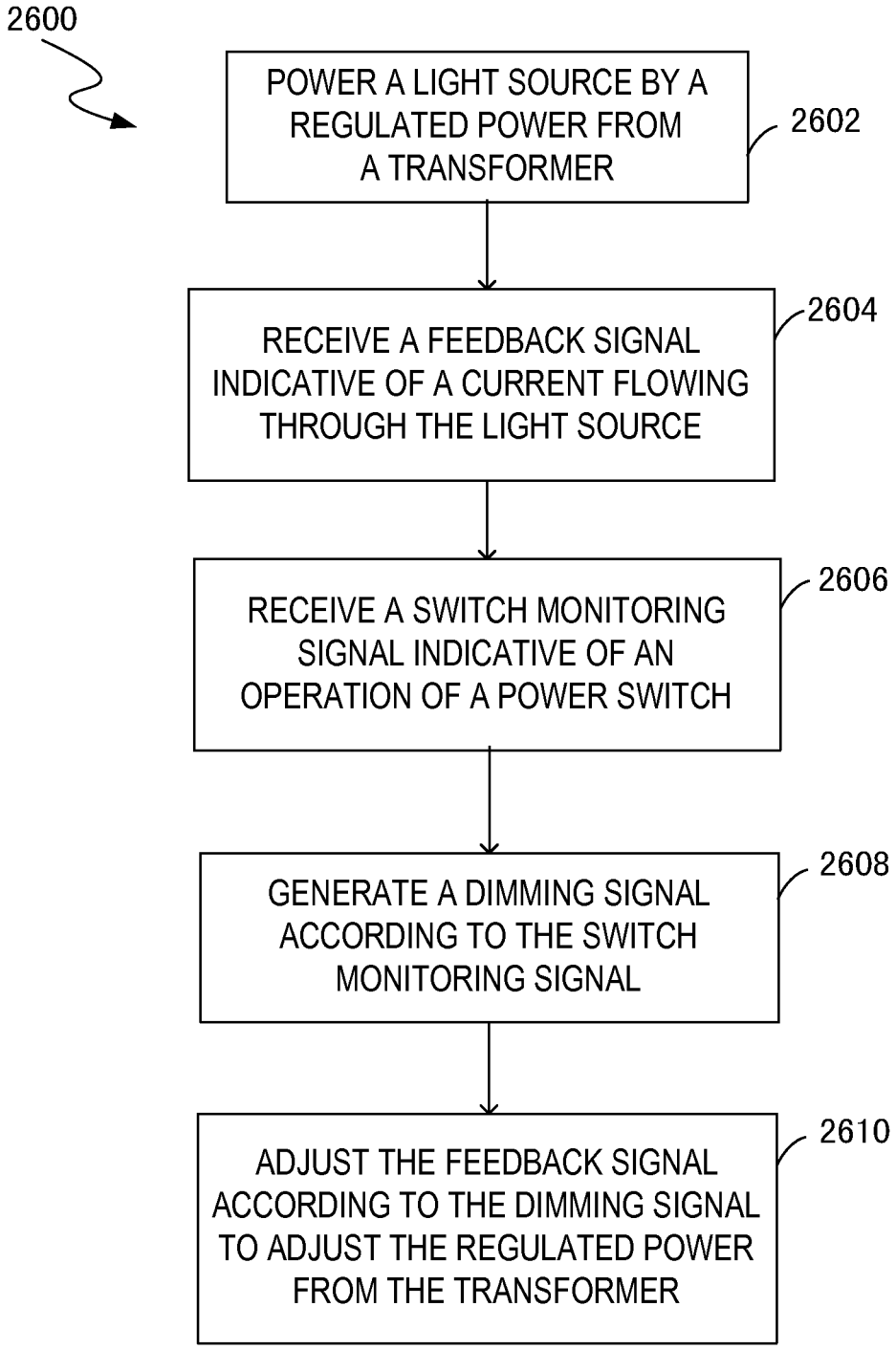
FIG. 26 shows a flowchart of a method for adjusting power of an LED light source, in accordance with one embodiment of the present invention.

FIG. 26 shows a flowchart 2600 of a method for adjusting power of a light source, e.g., an LED light source, in accordance with one embodiment of the present invention. FIG. 26 is described in combination with FIG. 20, FIG. 21, FIG. 23, and FIG. 24.

In block 2602, a light source, e.g., the LED string 1812, is powered by regulated power from a DC/DC converter, e.g., the isolated DC/DC converter 1807. In block 2604, a feedback signal CFB indicative of a target level of a current flowing through the light source is received, e.g., by the switch controller 1810. In block 2606, a switch monitoring signal TS is received, e.g., by the dimming controller 1816 in the secondary side. The switch monitoring signal TS indicates an operation of a power switch in the primary side, e.g., the power switch 1804. In block 2608, a dimming signal is generated according to the switch monitoring signal TS. In block 2610, the driving signal DRV is adjusted according to the dimming signal so as to control a switch coupled in series with a primary winding of a transformer in the DC/DC converter, e.g., the control switch Q1, and to regulate the power from the DC/DC converter. In one embodiment, in an analog dimming mode, the power from the DC/DC converter is regulated by comparing the dimming signal with a current monitoring signal SEN which indicates a current flowing through the light source. In another embodiment, in a burst dimming mode, the power from the DC/DC converter is regulated by controlling a duty cycle of a pulse-width modulation signal according to the dimming signal.

Accordingly, embodiments in accordance with the present invention provide a driving circuit that controls power of a light source, e.g., an LED light source, according to a switch monitoring signal indicative of an operation of a power switch, e.g., an on/off switch mounted on the wall. The power of the light source, which is provided by an isolated DC/DC converter, can be adjusted by a dimming controller by controlling a switch coupled in series with a primary winding of a transformer in the DC/DC converter. Advantageously, users can adjust the light output of the light source through an operation (e.g., a turn-off operation) of a low-cost on/off power switch. Therefore, extra apparatus for dimming, such as a specially designed switch with adjusting buttons, can be avoided and the cost can be reduced.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A driving circuit for controlling power of a light-emitting diode (LED) light source, said driving circuit comprising:

a transformer having a primary winding that receives input power from an AC/DC converter and having a secondary winding that provides output power to said LED light source;

a switch controller, coupled between an optical coupler and said primary winding, that receives a feedback signal indicative of a target level of a current flowing through said LED light source from said optical coupler, and that controls input power to said primary winding according to said feedback signal; and a dimming controller, coupled to said secondary winding, that receives a switch monitoring signal indicative of an operation of a power switch coupled between an AC power source and said AC/DC converter, and that regulates said output power of said transformer by adjusting said feedback signal according to said switch monitoring signal.

2. The driving circuit of claim 1, wherein said LED light source comprises an LED string.

3. The driving circuit of claim 1, wherein said operation of said power switch comprises a turn-off operation.

4. The driving circuit of claim 1, wherein said transformer further comprises an auxiliary winding that provides power to said switch controller.

5. The driving circuit of claim 1, wherein said switch controller generates a pulse-width modulation (PWM) signal to selectively turn on a control switch coupled in series with said primary winding, and adjusts said output power of said transformer by adjusting a duty cycle of said PWM signal.

6. The driving circuit of claim 1, wherein said dimming controller monitors a voltage of said switch monitoring signal so as to monitor said operation of said power switch.

7. The driving circuit of claim 1, wherein said dimming controller comprises:

a trigger monitoring unit that receives said switch monitoring signal, and that generates a driving signal in response to said operation of said power switch; and a dimmer, coupled to said trigger monitoring unit, that generates a dimming signal to adjust said feedback signal based on said driving signal.

8. The driving circuit of claim 7, wherein said dimmer comprises:

a counter driven by said driving signal; and a digital-to-analog converter, coupled to said counter, that generates said dimming signal based on a counter value of said counter.

9. The driving circuit of claim 8, wherein said dimming controller resets said counter when said power switch remains off over a predetermined time period.

10. The driving circuit of claim 7, wherein said dimming controller operates in a burst dimming mode in which a pulse-width modulation (PWM) signal is generated based on said dimming signal, wherein a duty cycle of said PWM signal is determined by said dimming signal, and wherein said PWM signal adjusts said feedback signal and controls a second switch coupled in series with said LED light source.

11. The driving circuit of claim 7, wherein said dimming controller operates in an analog dimming mode in which an operational amplifier compares said dimming signal with a current monitoring signal indicating said current flowing through said LED light source and generates a compensation signal to adjust said feedback signal.

12. A dimming controller that is electrically coupled to a secondary winding of a transformer and controls power from an AC/DC converter to a light-emitting diode (LED) light source, said dimming controller comprising:

a switch monitoring terminal that receives a switch monitoring signal indicating an operation of a power switch coupled between an AC power source and said AC/DC converter;

a current monitoring terminal that receives a current monitoring signal indicating a current flowing through said LED light source; and a compensation terminal that generates a compensation signal to control a control switch in series with a primary winding of said transformer to adjust power to said LED light source based on said operation of said power switch and said current monitoring signal.

13. The dimming controller of claim 12, wherein said operation of said power switch comprises a turn-off operation.

14. The dimming controller of claim 12, wherein said switch monitoring terminal monitors a voltage of said switch monitoring signal so as to monitor said operation of said power switch.

15. The dimming controller of claim 12, wherein said dimming controller pulls a voltage at said compensation terminal to zero in response to an over-voltage signal indicating an over-voltage condition of said LED light source.

16. The dimming controller of claim 12, further comprising:

a trigger monitoring unit that receives said switch monitoring signal from said switch monitoring terminal, and that generates a driving signal in response to said operation of said power switch; and a dimmer, coupled to said trigger monitoring unit, that generates a dimming signal to adjust said compensation signal based on said driving signal.

17. The dimming controller of claim 16, further comprising:

a counter driven by said driving signal; and a digital-to-analog converter, coupled to said counter, that generates said dimming signal based on a counter value of said counter.

18. The dimming controller of claim 17, wherein said dimming controller resets said counter when said power switch remains off over a predetermined time period.

19. The dimming controller of claim 16, wherein said dimming controller operates in a burst dimming mode in which a pulse-width modulation signal (PWM) is generated based on said dimming signal, wherein a duty cycle of said PWM signal is determined by said dimming signal, and wherein said PWM signal adjusts said compensation signal and controls a second switch coupled in series with said LED light source.

20. The dimming controller of claim 16, wherein said dimming controller operates in an analog dimming mode in which an operational amplifier compares said dimming signal with said current monitoring signal and generates said compensation signal.

* * * * *